US007314692B2

(12) United States Patent
Kim et al.

(10) Patent No.: US 7,314,692 B2
(45) **Date of Patent: *Jan. 1, 2008**

(54) PHENYLAZOMETHYLENE-CYCLOHEXADIENONE DERIVATIVES COMPRISING ELECTRON WITHDRAWING GROUP AND ELECTROPHOTOGRAPHIC PHOTORECEPTOR COMPRISING THE DERIVATIVES

(75) Inventors: Beom-jun Kim, Seongnam-si (KR); Saburo Yokota, Suwon-si (KR); Kyung-yol Yon, Seongnam-si (KR); Hwan-koo Lee, Suwon-si (KR); Seung-ju Kim, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 511 days.

This patent is subject to a terminal disclaimer.

(21) Appl. No.: 10/964,740

(22) Filed: Oct. 15, 2004

(65) Prior Publication Data

US 2005/0130051 A1 Jun. 16, 2005

(30) Foreign Application Priority Data

Dec. 15, 2003 (KR) ..... 10-2003-0091437

(51) Int. Cl.
*G03G 5/047* (2006.01)

(52) U.S. Cl. ..... 430/58.25; 430/60; 430/70; 430/78

(58) Field of Classification Search ..... 430/58.25, 430/60, 70, 78

See application file for complete search history.

(56) References Cited

U.S. PATENT DOCUMENTS 1,935,945 A 11/1933 Eckert et al.

(Continued)

FOREIGN PATENT DOCUMENTS

JP 2000-147806 5/2000

(Continued)

OTHER PUBLICATIONS

Abstract of JP 2001215742.*

(Continued)

*Primary Examiner*—Hoa Van Le
(74) *Attorney, Agent, or Firm*—Staas & Halsey LLP

(57) ABSTRACT

A phenylazomethylene-cyclohexadienone derivative and an electrophotographic photoreceptor include a compound that is represented by the following formula:

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; A is selected from the group consisting of nitro group, cyano group and sulfone group; l is a natural number of 0 to 4; m is a natural number of 0 to 4; and n is a natural number of 1 to 5, and the electrophotographic photoreceptor according to the present invention comprises the phenylazomethylene-cyclohexadienone derivative. An electrophotographic photoreceptor having an improved electrical characteristic and a desirable image quality is provided.

28 Claims, 3 Drawing Sheets

U.S. PATENT DOCUMENTS

| | | | |
|---|---|---|---|
| 2,087,133 | A | 7/1937 | Vollmann |
| 3,931,224 | A | 1/1976 | Santa et al. |
| 4,442,193 | A | 4/1984 | Chen et al. |
| 4,992,349 | A | 2/1991 | Chen et al. |
| 5,468,583 | A | 11/1995 | Gruenbaum et al. |
| 5,541,169 | A | 7/1996 | Deushi et al. |
| 5,558,965 | A | 9/1996 | Nguyen et al. |
| 5,886,183 | A | 3/1999 | Langhals et al. |
| 6,287,736 | B1 | 9/2001 | Takaki et al. |
| 6,391,505 | B1 | 5/2002 | Hmasaki et al. |
| 6,472,514 | B2 | 10/2002 | Kuroda |
| 2005/0153005 | A1 | 7/2005 | Schmid et al. |

FOREIGN PATENT DOCUMENTS

| | | |
|---|---|---|
| JP | 2003-030306 | 11/2000 |
| JP | 2001-066805 | 3/2001 |
| JP | 2001-215742 | 8/2001 |
| JP | 2003/029436 | 1/2003 |
| JP | 2003-292467 | 10/2003 |
| JP | 2005-122127 | 5/2005 |

OTHER PUBLICATIONS

Borsenberger, Paul M. et al. Organic Photoreceptors for Imaging Systems, New York: Marcer-Dekker, Inc. (1993) pp. 356-361.

Diamond, Arthur S. & David Weiss (eds.) Handbook of Imaging Materials, New York Marcel-Dekker, Inc., (Nov. 2001) pp. 381-382.

U.S. Appl. No. 10/768,083, filed Feb. 2, 2004, Seung-Ju Kim, Samsung Electronics Co., Ltd., Suwon-si, Republic of Korea.

Korean Patent Office Action for corresponding Korean Patent Application No. 10-2003-0091437 dated Mar. 3, 2006.

* cited by examiner

PHENYLAZOMETHYLENE-CYCLOHEXADIENONE DERIVATIVES COMPRISING ELECTRON WITHDRAWING GROUP AND ELECTROPHOTOGRAPHIC PHOTORECEPTOR COMPRISING THE DERIVATIVES

CROSS-REFERENCE TO RELATED APPLICATIONS

This application claims the benefit of Korean Application No. 2003-91437, filed on Dec. 15, 2003, in the Korean Intellectual Property Office, the disclosure of which is incorporated herein by reference.

BACKGROUND OF THE INVENTION

1. Field of the Invention

The present invention relates to a new phenylazomethylene-cyclohexadienone derivative having an improved electron transferring capacity and an electrophotographic photoreceptor comprising the same. More particularly, the present invention relates to a new phenylazomethylene-cyclohexadienone derivative comprising an electron withdrawing group having a high electron affinity and an electrophotographic photoreceptor comprising the derivative singly or in combination with another compound having an electron transferring capacity as an electron transferring material of a photoconductive layer or undercoating layer.

2. Description of the Related Art

An electrophotographic photoreceptor is employed in electrophotographic image-forming apparatuses, such as facsimiles, copiers, laser beam printers, CRT printers, LED printers, liquid crystal printers, laser electrophotographs, and so on. Basically, in the electrophotographic image-forming apparatus, a photoconductive material is charged and exposed to an image-forming light source to form an electrostatic latent image. Then, the image is developed with toner (also referred to as ink) by applying a developing voltage, and after the toner image is transferred to a recording medium such as paper, or the like, the image is fixed thereon.

The electrophotographic photoreceptor comprises a photoconductive layer containing a charge generating material (CGM), a charge transferring material (CTM), and the like on a conductive substrate. Generally, the electrophotographic photoreceptor contains an additional functional layer; for example, an undercoating layer is formed between the conductive substrate and the photoconductive layer, or a protective layer is formed on the photoconductive layer.

The charge generating material of the photoconductive layer may be divided into two classes: an inorganic compound and an organic compound. The organic compound has generally been used as the charge generating material in recent years, considering environmental pollution, and the like. The photoreceptor in which this organic compound is used as the charge generating material is also referred to as an organic photoreceptor.

The photoconductive layer may have a single layer structure in which the charge generating material and the charge transferring material are dispersed together in a single layer, or a laminate (or multi-layer) structure in which the charge generating material and the charge transferring material are dispersed separately in a charge generating layer and a charge transferring layer, respectively. The photoconductive layer is classified into a (+) type and a (−) type, according to its potential to be generated upon charging. The single layer type photoreceptor has been studied mainly in the field of (+) type photoreceptor production, and the laminate type photoreceptor has been studied mainly in the field of (−) type photoreceptor production.

The photoconductive layer of the (+) type photoreceptor includes an electron transferring material, a binder resin and a charge generating material, and, in some cases, additionally includes a hole transferring material. Since the electron transferring capacity of the electron transferring material which is commonly used is 100 or more times smaller than the hole transferring capacity of the hole transferring material, the capacity of the photoreceptor is significantly influenced by the electron transferring capacity of the electron transferring material. Therefore, among materials included in the photoconductive layer of the (+) type photoreceptor, the selection of the electron transferring material is of significant importance.

The electron transferring capacity of the electron transferring material is significantly influenced by the electron affinity of the electron transferring material itself. Even when the electron transferring capacity of the electron transferring material is excellent, if the material alone cannot accept electrons effectively, it is common to use the material together with a material that aids the electron acceptance.

The conventional electron transferring material generally includes compounds having a naphthalenetetracarboxylic diimide structure, a dicyanofluorenone structure, a diphenoquinone structure, a phenylazomethylene-cyclohexadienone structure, or the like.

The compound having a naphthalenetetracarboxylic diimide structure represented by the following Formula 1 has an excellent electron transferring capacity, but lacks the capacity for accepting electrons from the charge generating material; therefore, another electron accepting material (or electron acceptor: EA) is needed. If the compound having the naphthalenetetracarboxylic diimide structure is used singly as an electron transferring material without the electron accepting material, the charging potential is seriously reduced, and the exposure potential is increased after repeated charging and exposure.

Formula 1

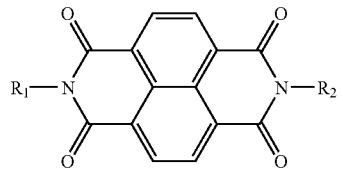

The compound having a dicyanofluorenone structure represented by the following Formula 2 has a poor electron transferring capacity, and therefore, even though the compound is used with an electron acceptor, the charging potential is seriously reduced, and the exposure potential is increased after repeated charging and exposure.

Formula 2

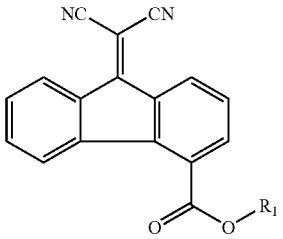

The compound having a diphenoquinone structure represented by the following Formula 3 is an electron transferring material that is commonly used and also serves as an electron accepting material. When the diphenoquinone compound is used singly or in combination with another compound having an electron transferring capacity, a stable charging potential and an exposure potential may be attained after repeated charging and exposure. However, when the diphenoquinone compound is used singly as an electron transferring material, the charging potential to be attained is stable but low, and thus, the image quality of the final printed image of the electrophotographic photoreceptor using the diphenoquinone compound is inferior.

Formula 3

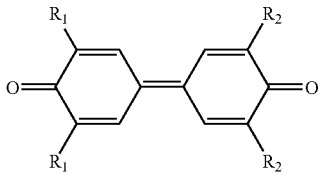

The compound having the phenylazomethylene-cyclohexadienone structure represented by the following Formula 4 is disclosed in U.S. Pat. No. 6,472,514.

Formula 4

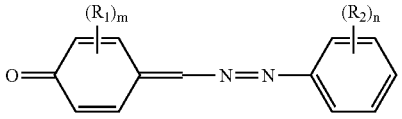

However, the electron transferring capacity of the compound disclosed in the above patent is ineffective, and the sensitivity and the remaining potential are substantial, indicating that the remaining potential is substantial after erasing after exposure, and therefore, the compound has a characteristic which is not suitable for an electrophotographic image forming apparatus.

Thus, an electron transferring material which itself has an effective electron accepting capacity without requiring another electron accepting material, and which also has an effective electron transferring capacity, is still needed.

SUMMARY OF THE INVENTION

The present invention has been developed to solve the above and/or other problems. An aspect of the present invention is to synthesize a phenylazomethylene-cyclohexadienone derivative comprising an electron withdrawing group, and thus, provide a compound having an improved electron accepting capacity and electron transferring capacity.

Another aspect of the present invention is to provide an electrophotographic photoreceptor having an improved electrostatic characteristic by using the phenylazomethylene-cyclohexadienone derivative comprising an electron withdrawing group having an improved electron accepting capacity and electron transferring capacity.

The phenylazomethylene-cyclohexadienone derivative according to an embodiment of the present invention that achieves the above aspect is represented by the following Formula 5:

Formula 5

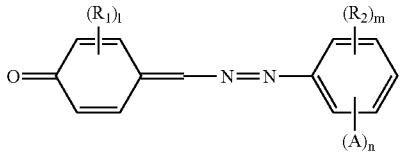

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; A is selected from the group consisting of a nitro group, a cyano group and a sulfone group; l is a natural number of 0 to 4; m is a natural number of 0 to 4; and n is a natural number of 1 to 5.

The phenylazomethylene-cyclohexadienone derivative according to an embodiment of the present invention may be prepared by a method comprising: an operation of dissolving the compound represented by the following Formula 6:

Formula 6

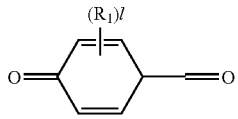

wherein $R_1$ is selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen, and l is a natural number of 0 to 4, and the compound represented by the following Formula 7:

Formula 7

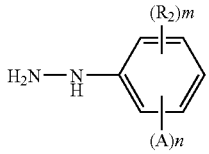

wherein $R_2$ is selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen, A is selected from the group consisting of a nitro group, a cyano group and a sulfone group, m is a natural number of 0 to 4, and n is a natural number of 1 to 5, in a first organic solvent to prepare a first solution; a step of extracting from the first solution a solid compound represented by the following Formula 8:

Formula 8

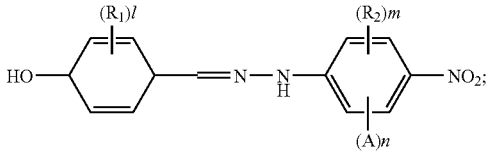

an operation of dissolving the extracted solid compound in a second organic solvent to prepare a second solution; and an operation of extracting from the second solution a solid compound represented by the following Formula 9:

Formula 9

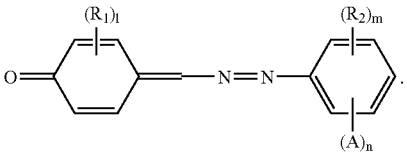

In addition, the electrophotographic photoreceptor according to an embodiment of the present invention to achieve an above aspect comprises a conductive substrate; and a photoconductive layer formed on the conductive substrate, wherein the photoconductive layer includes a charge generating material and a charge transferring material, and the charge transferring material comprises a phenylazomethylene-cyclohexadienone derivative represented by the following Formula 10:

Formula 10

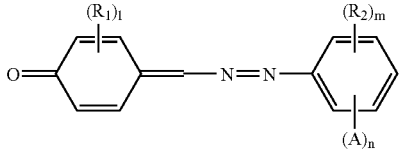

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; A is selected from the group consisting of a nitro group, a cyano group and a sulfone group; l is a natural number of 0 to 4; m is a natural number of 0 to 4; and n is a natural number of 1 to 5.

It is typical that the content of the electron transferring material is in the range of 0.1 to 4% by weight with respect to the total solid.

The electron transferring material is generally a mixture of the phenylazomethylene-cyclohexadienone derivative of the above Formula 10 and the compound of the following Formula 11:

Formula 11

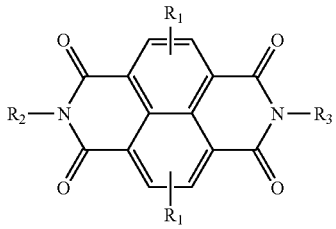

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

In the above mixture, it is typical that a mixing ratio of {the phenylazomethylene-cyclohexadienone derivative of Formula 10}/{the phenylazomethylene-cyclohexadienone derivative of Formula 10+the compound of Formula 11} is in a range of 0.01 to 1.

The electron transferring material is generally a mixture of the phenylazomethylene-cyclohexadienone derivative of the above Formula 10 and the compound of the following Formula 12:

Formula 12

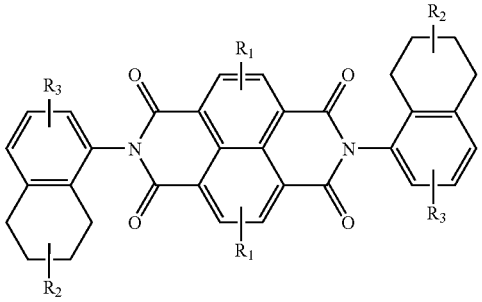

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

In the above mixture, it is typical that a mixing ratio of {the phenylazomethylene-cyclohexadienone derivative of Formula 10}/{the phenylazomethylene-cyclohexadienone derivative of Formula 10+the compound of Formula 12} is in a range of 0.01 to 1.

The electron transferring material is generally a mixture of the phenylazomethylene-cyclohexadienone derivative of the above Formula 10 and the compound of the following Formula 13:

Formula 13

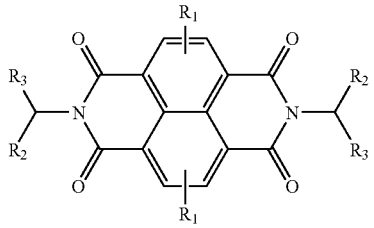

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; and $R_3$ is a substituted or unsubstituted aryl group having 6 to 30 carbon atoms.

In the above mixture, it is typical that a mixing ratio of {the phenylazomethylene-cyclohexadienone derivative of Formula 10}/{the phenylazomethylene-cyclohexadienone derivative of Formula 10+the compound of Formula 13} is in a range of 0.01 to 1.

Generally, the electrophotographic photoreceptor, according to an embodiment of the present invention, is a photoreceptor having a photoconductive layer with a single layer structure wherein the charge transferring material and the charge generating material are dispersed together in a single layer. Generally, the electrophotographic photoreceptor additionally contains a hole transferring material.

Alternatively, the electrophotographic photoreceptor, according to an embodiment of the present invention, may be a photoreceptor having a photoconductive layer with a laminate structure wherein the charge transferring material and the charge generating material are dispersed in separate layers respectively.

Generally, the electrophotographic photoreceptor according to an embodiment of the present invention additionally contains an undercoating layer between the conductive substrate and the photoconductive layer to improve the adhesive property between the conductive substrate and the photoconductive layer.

Typically, the electrophotographic photoreceptor according to an embodiment of the present invention additionally contains a protective layer on the photoconductive layer to protect the photoconductive layer.

In addition, the electrophotographic photoreceptor according to an embodiment of the present invention that achieves the above object comprises a conductive substrate; a photoconductive layer formed on the conductive substrate; and an undercoating layer formed between the conductive substrate and the photoconductive layer to improve the adhesive property between the conductive substrate and the photoconductive layer, wherein the undercoating layer contains an electron transferring material, and the electron transferring material comprises a phenylazomethylene-cyclohexadienone derivative represented by the following Formula 14:

Formula 14

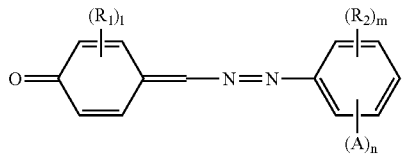

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; A is selected from the group consisting of nitro group, cyano group and sulfone group; l is a natural number of 0 to 4; m is a natural number of 0 to 4; and n is a natural number of 1 to 5.

Typically, the content of the electron transferring material is in the range of 0.1 to 4% by weight with respect to the total solid.

The electron transferring material is generally a mixture of the phenylazomethylene-cyclohexadienone derivative of the above Formula 14 and the compound of the following Formula 15:

Formula 15

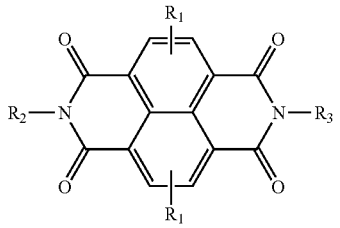

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

In the above mixture, generally a mixing ratio of {the phenylazomethylene-cyclohexadienone derivative of Formula 14}/{the phenylazomethylene-cyclohexadienone derivative of Formula 14+the compound of Formula 15} is in a range of 0.01 to 1.

Alternatively, the electron transferring material is generally a mixture of the phenylazomethylene-cyclohexadienone derivative of the above Formula 14 and the compound of the following Formula 16:

Formula 16

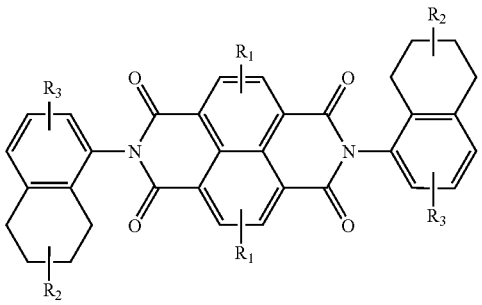

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

In the above mixture, typically a mixing ratio of {the phenylazomethylene-cyclohexadienone derivative of Formula 14}/{the phenylazomethylene-cyclohexadienone derivative of Formula 14+the compound of Formula 16} is in a range of 0.01 to 1.

Alternatively, the electron transferring material is typically a mixture of the phenylazomethylene-cyclohexadienone derivative of the above Formula 14 and the compound of the following Formula 17:

Formula 17

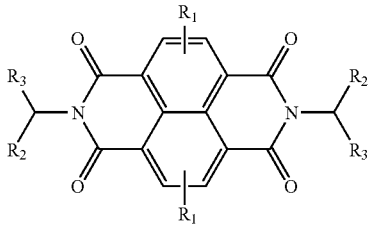

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; and $R_3$ is a substituted or unsubstituted aryl group having 6 to 30 carbon atoms.

In the above mixture, generally, a mixing ratio of {the phenylazomethylene-cyclohexadienone derivative of Formula 14}/{the phenylazomethylene-cyclohexadienone derivative of Formula 14+the compound of Formula 17} is in a range of 0.01 to 1.

In the above formulas, Formula 5, Formula 9, Formula 10 and Formula 14 are same and numbered in order of appearance for convenience of explanation; hereinafter, they are referred to as Formula 5. Similarly, since Formula 11 is the same as Formula 15, they are hereinafter referred to as Formula 11; since Formula 12 is the same as Formula 16, they are hereinafter referred to as Formula 12; and since Formula 13 is the same as Formula 17, they are hereinafter referred to as Formula 13.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects and features of the present invention will be more apparent by describing certain embodiments of the present invention with reference to the accompanying drawings, in which.

DETAILED DESCRIPTION OF THE PREFERRED EMBODIMENTS

Figure 1:
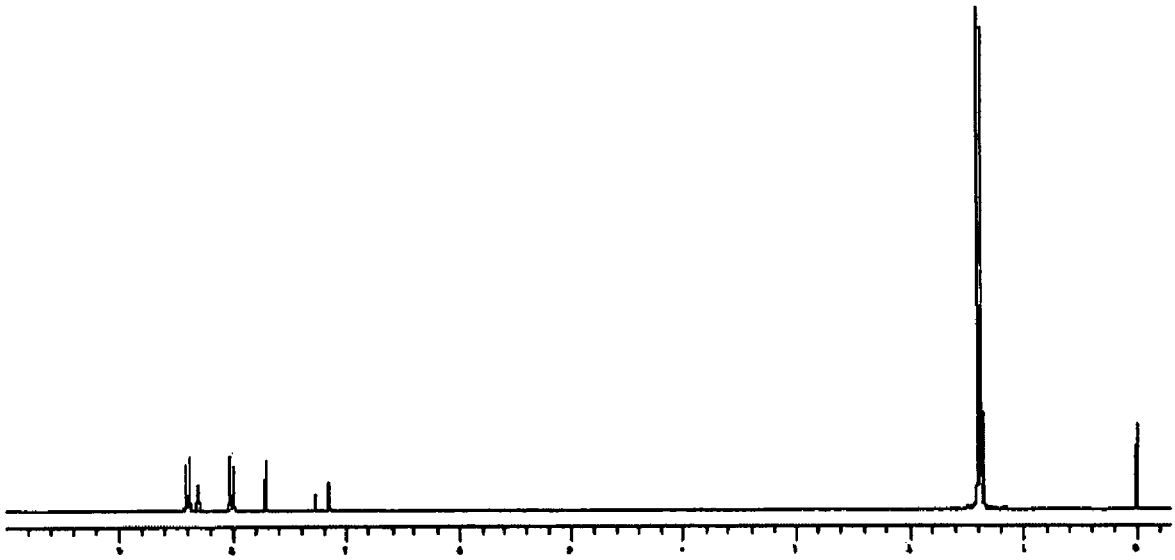
FIG. 1 is an NMR spectrum of a phenylazomethylene-cyclohexadienone derivative according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

The present invention will be described in greater detail with reference to the accompanying drawings and Examples.

The phenylazomethylene-cyclohexadienone derivative according to an embodiment of the present invention is represented by the above Formula 5, wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

In Formula 5, A is an electron withdrawing group selected from the group consisting of a nitro group, a cyano group and a sulfone group.

In Formula 5, l is a natural number of 0 to 4, m is a natural number of 0 to 4, and n is a natural number of 1 to 5.

The substituted or unsubstituted alkyl group having 1 to 20 carbon atom(s) may be linear or branched. Examples of the alkyl group include methyl, ethyl, n-propyl, isopropyl, n-butyl, isobutyl, sec-butyl, t-butyl, pentyl, hexyl, 1,2-dimethyl-propyl, 2-ethyl-hexyl, and the like, but the alkyl group is not limited thereto. If the carbon number of the alkyl group is greater than 20, aggregation between molecules of the compound occurs, and macromolecules are formed; thus, the dispersibility is lowered, and the electron transferring capacity is lowered. Therefore, generally, the carbon number of the alkyl group is 1 to 20. The substituent of the alkyl group is not limited.

The substituted or unsubstituted alkoxy group having 1 to 20 carbon atom(s) may be linear or branched. Examples of the alkoxy group include methoxy, ethoxy, propoxy, butoxy, pentyloxy, and the like, but the alkoxy group is not limited thereto. If the carbon number of the alkoxy group is more than 20, the dispersibility lowering, the electron transferring capacity lowering, and the like, due to aggregation between molecules of the compound occurs in the same manner as with the alkyl group; thus, generally, the carbon number of the alkoxy group is 1 to 20. The substituent of the alkoxy group is not limited.

For the substituted or unsubstituted aryl group having 6 to 30 carbon atoms, generally, the carbon number of the aryl group is 6 to 30 to assure the dispersibility and electron transferring capability of the compound of the above Formula 5 for the same reason as that with the alkyl group and the alkoxy group. Examples of the aryl group include phenyl, tolyl, xylyl, biphenyl, o-terphenyl, naphthyl, anthryl, phenanthryl, and the like, but the aryl group is not limited thereto.

For the substituted or unsubstituted aralkyl group having 7 to 30 carbon atoms, generally, the carbon number of the aralkyl group is 7 to 30 since the dispersibility and electron transferring capability of the compound of the above Formula 5 are lowered when the carbon number of the aralkyl group is greater than 30 for the same reason as that with the alkyl group, the alkoxy group and the aryl group. The term aralkyl group, as used herein, refers to a $Ar(CH_2)_n$— group in which a carbon atom of an alkyl group is substituted with an aromatic hydrocarbon group (aryl group) such as phenyl, tolyl, or the like, and is shortened from the terminology "arylalkyl group." Examples of the aralkyl group include benzyl ($C_6H_5CH_2$—), phenethyl ($C_6H_5CH_2CH_2$—), and the like, but the aralkyl group in not limited thereto.

The halogen may be one from a halogen group, such as fluorine or chlorine.

A is an electron withdrawing group and is selected from the group consisting of a nitro group, a cyano group and a sulfone group. The electron withdrawing group is also referred to as an electron attracting group, and refers to an atomic group which draws electrons from surrounding atomic groups by a resonance effect or an inductive effect in electron theory. Especially, a nitro group (—$NO_2$) of nitrobenzene is a representative electron withdrawing group and draws electrons from surrounding atomic groups to a benzene nucleus by a resonance structure of the benzene ring and an inductive effect of the nitrogen atom in addition. This electron withdrawing group includes nitroso, carbonyl, carboxyl, cyano, trialkylaluminium, trifluoromethyl, sulfone, and the like. Although the compound of the present invention is targeted to a compound having a group substituted with a nitro group, a cyano group or a sulfone group, substitution with other electron withdrawing groups having an equivalent effect is not excluded.

l is set to a natural number of 0 to 4, m is set to a natural number of 0 to 4, and n is set to a natural number of 1 to 5, according to experiments considering the dispersibility and electron transferring capacity of the compound.

The phenylazomethylene-cyclohexadienone derivative represented by Formula 5 according to an embodiment of the present invention is exemplified by the following compounds, but is not limited thereto.

Formula 18

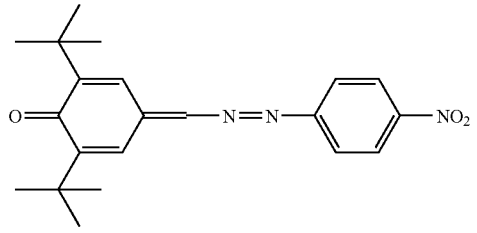

Formula 19

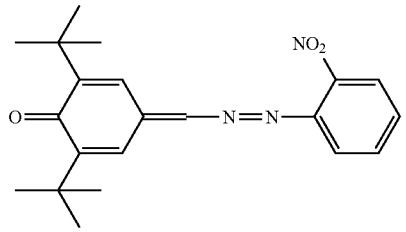

Formula 20

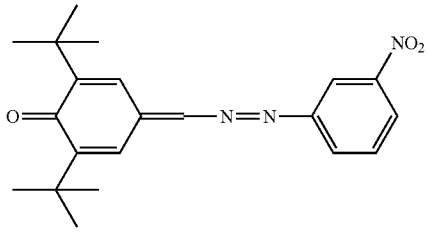

-continued
Formula 21
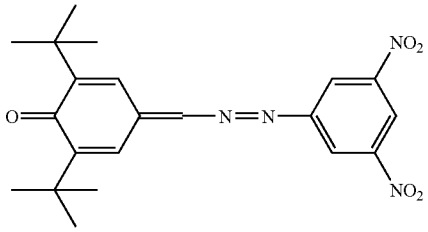
Formula 22
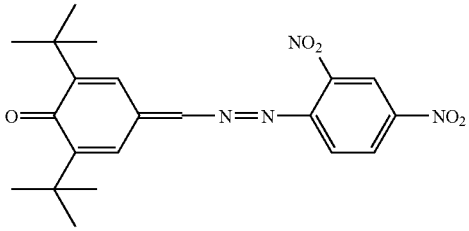
Formula 23
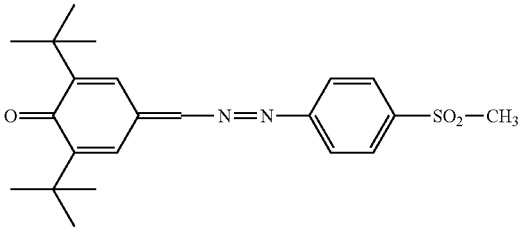
Formula 24
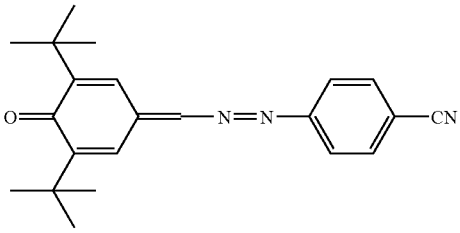
Formula 25
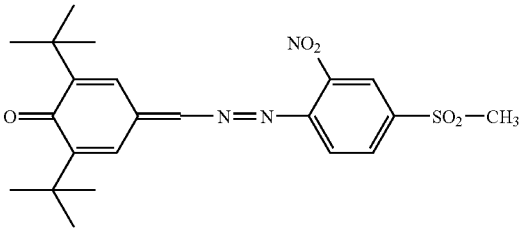
Formula 26
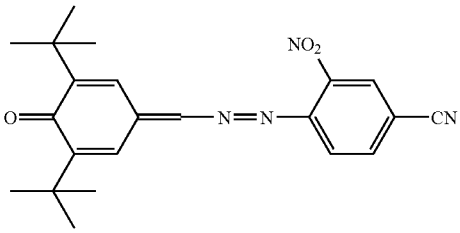
-continued
Formula 27
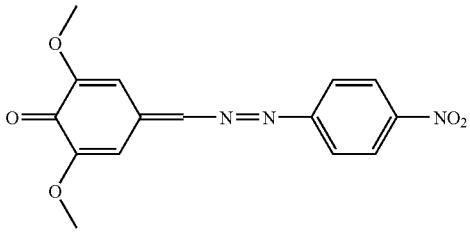
Formula 28
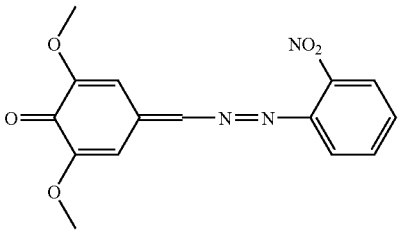
Formula 29
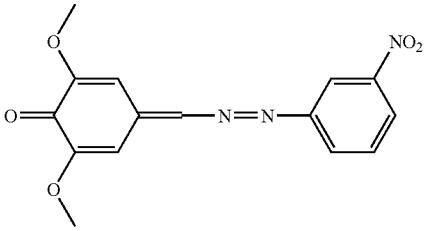
Formula 30
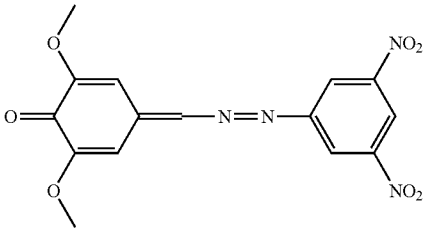
Formula 31
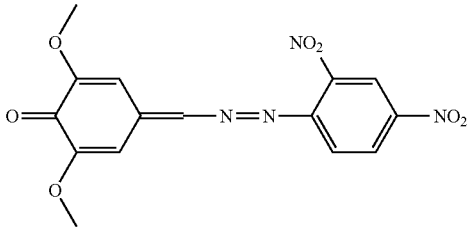
Formula 32
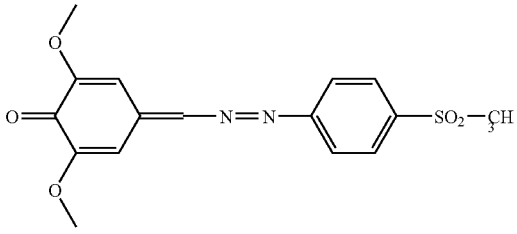

-continued

Formula 33

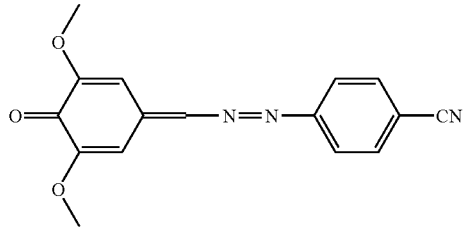

Formula 34

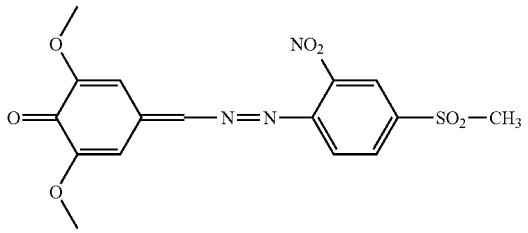

Formula 35

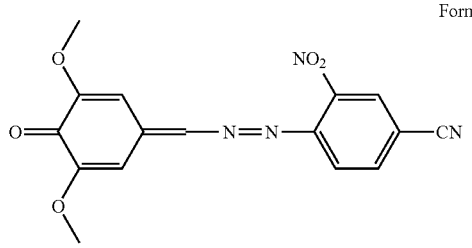

The method to prepare the compound of the above Formula 5 is described in the following, and is exemplified in Example 1.

First, reactants of the above Formula 6 and Formula 7 are dissolved in a first organic solvent to prepare a first solution. Then, an intermediate compound represented by the above Formula 8 is synthesized from this solution. This reaction is shown in the following Reaction Scheme 1.

Reaction Scheme 1

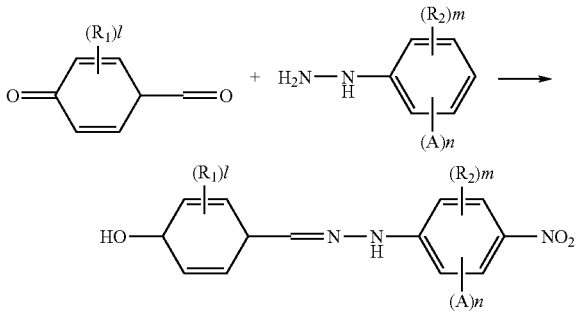

The intermediate compound synthesized through the above Reaction Scheme 1 is dissolved in a second organic solvent to prepare a second solution. Then, the compound represented by the above Formula 5 is synthesized from this second solution. This reaction is shown in the following Reaction Scheme 2.

Reaction Scheme 2

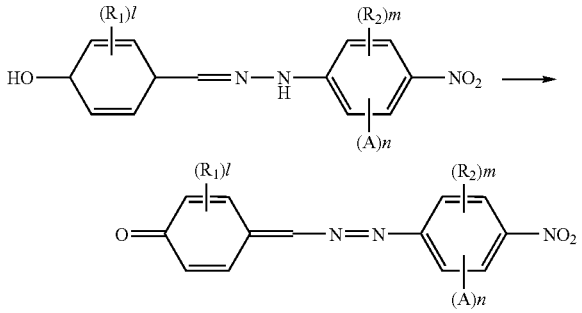

As shown in the above Reaction Schemes 1 and 2, each substituent of the compound represented by the above Formula 5 originates from reactants, i.e., compounds of Formula 6 and Formula 7, and remains as it is in the phenylazomethylene-cyclohexadienone derivative of Formula 5 which results from the reactions.

The synthesis of the phenylazomethylene-cyclohexadienone derivative as described above may be understood through the synthesis of the phenylazomethylene-cyclohexadienone derivative of Formula 18 in Example 1. The NMR spectrum of the phenylazomethylene-cyclohexadienone derivative of Formula 18 was measured and is shown in FIG. 1.

Using the phenylazomethylene-cyclohexadienone derivative synthesized according to an embodiment of the present invention, an electrophotographic photoreceptor may be prepared. The electrophotographic photoreceptor according to an embodiment of the present invention may comprise the above-described phenylazomethylene-cyclohexadienone derivative as an electron transferring material or an electron accepting material of a photoconductive layer or undercoating layer.

The electrophotographic photoreceptor according to an embodiment of the present invention is described in the following.

The electrophotographic photoreceptor comprises a conductive substrate and a photoconductive layer formed on the conductive substrate.

The conductive substrate is a material which is electrically conductive. As the material for the conductive substrate, it is possible to use, for example, metals such as aluminum, copper, tin, platinum, gold, silver, vanadium, molybdenum, chrome, cadmium, titanium, nickel, indium, stainless still or brass; plastic materials on which the metal is deposited or laminated; or glasses coated with aluminum iodide, tin oxide, indium oxide; and the like, but the present invention is not limited thereto. Said materials may be used in the form of a drum or a belt.

The photoconductive layer may be of either a laminate type, wherein a charge generating layer and a charge transferring layer are laminated, or a single layer type, wherein a charge generating material and a charge transferring material are dispersed in a single layer.

The charge generating material which may be used in the photoconductive layer is divided into an inorganic compound and an organic compound, wherein the organic compound has generally been used as the charge generating material considering environmental pollution, and the like. Therefore, the photoreceptor is also referred to as organic photoreceptor. The charge generating material, which is an organic compound, includes phthalocyanine type pigments, azo type pigments, quinone type pigments, pherylene type pigments, indigo type pigments, bisbenzoimidazole type pigments, quinaclydone type pigments, pyrilium type pigments, triarylmethane type pigments, cyanine type pigments, and the like, but is not limited thereto. The above-mentioned charge generating materials may be used individually or in combination with each other.

The charge transferring material included in the photoconductive layer may be divided into a hole transferring material and an electron transferring material, and in the case of a single layer type photoconductive layer, it is common that the electron transferring material and the hole transferring material are together.

As the electron transferring material of the photoconductive layer, the phenylazomethylene-cyclohexadienone derivative of Formula 5 according to an embodiment of the present invention is used.

When the compound of Formula 5 according to an embodiment of the present invention is used as the electron transferring material of the photoconductive layer, its contents are in the range of 0.1 to 4% by weight with respect to the total solid. If the content is less than 0.1% by weight, the electron transferring capacity cannot be achieved, and if the content is greater than 4% by weight, the exposure potential becomes higher than is desirable.

Alternatively, as the electron transferring material, a mixture of the phenylazomethylene-cyclohexadienone derivative of Formula 5 according to an embodiment of the present invention and one selected from the compound of the above Formula 11, the compound of the above Formula 12 and the compound of the above Formula 13 may be used. When this mixture is used as the electron transferring material, the compound of the above Formula 5 functions mainly to accept electrons, and the compound of the above Formula 11, the compound of the above Formula 12 or the compound of the above Formula 13 functions to transfer electrons.

When the mixture is used as the electron transferring material, a mixing ratio of {the phenylazomethylene-cyclohexadienone derivative of Formula 5}/{the phenylazomethylene-cyclohexadienone derivative of Formula 5+the compound of Formula 11 or the compound of Formula 12 or the compound of Formula 13} is in a range of 0.01 to 1. If the ratio is less than 0.01, the effect of the phenylazomethylene-cyclohexadienone derivative included in the mixture cannot be expected, and the maximum value of the ratio is 1, since the phenylazomethylene-cyclohexadienone derivative may be added up to 100% maximally.

The compound of the above Formula 11, the compound of the above Formula 12, and the compound of the above Formula 13 are exemplified by the following compounds, but are not limited thereto.

Formula 36

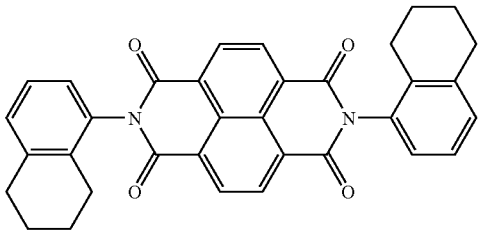

-continued

Formula 37

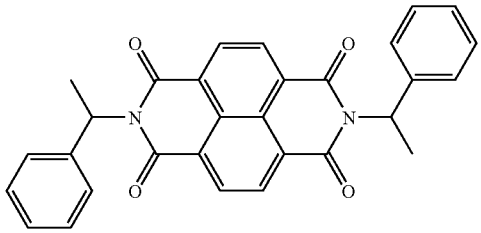

Formula 38

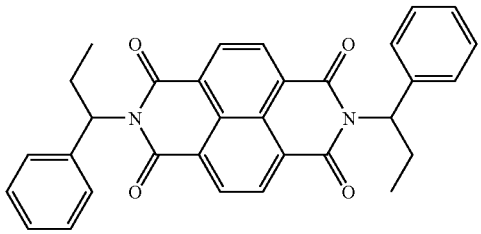

Formula 39

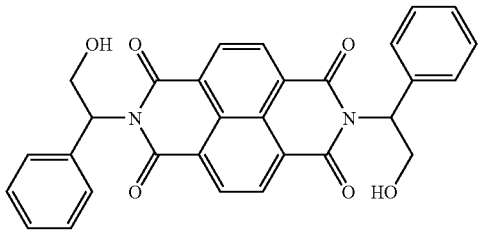

Formula 40

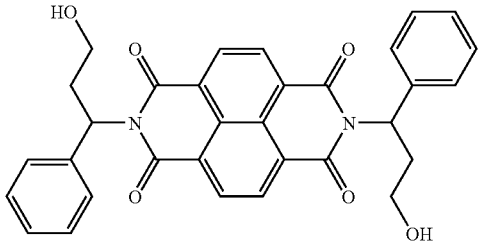

Formula 41

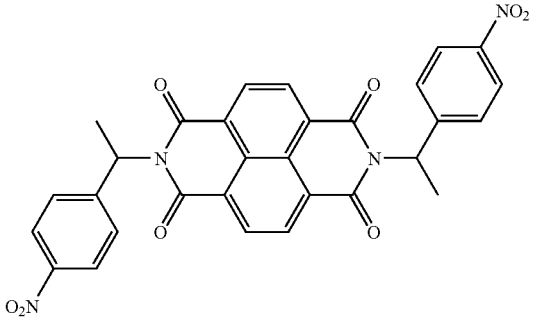

-continued
Formula 42
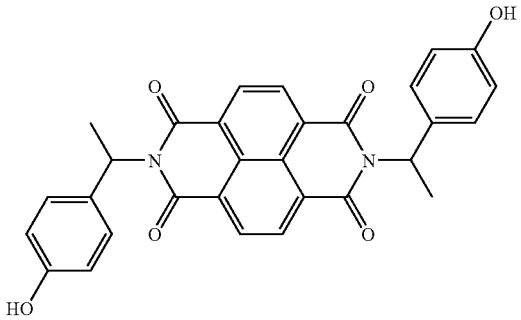
Formula 43
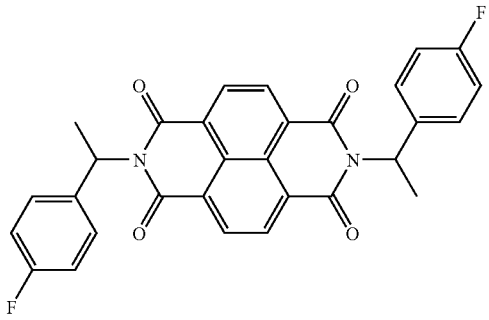
Formula 44
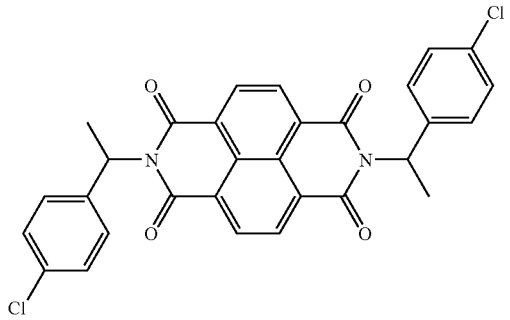
Formula 45
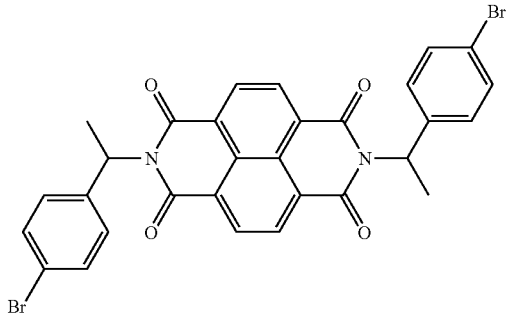
Formula 46
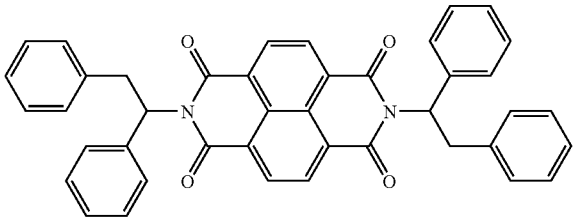
-continued
Formula 47
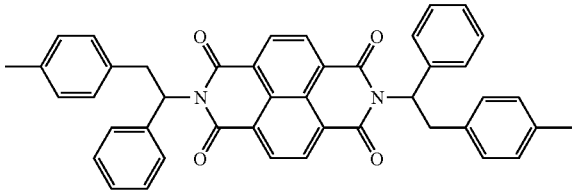
Formula 48
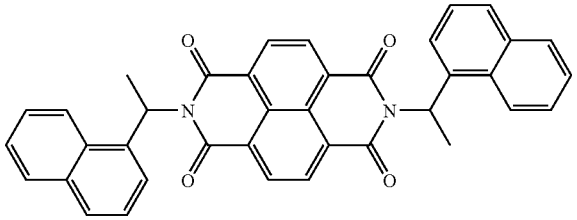
Formula 49
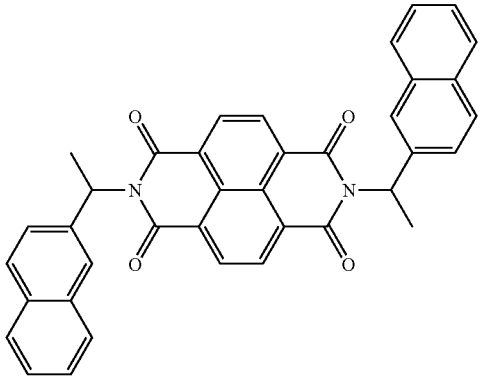
Formula 50
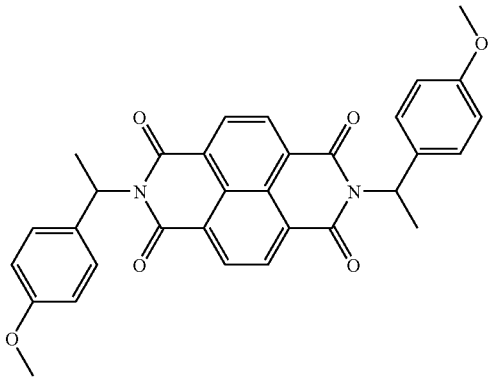
Formula 51
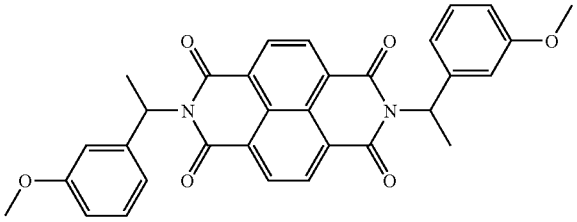

-continued

Formula 52

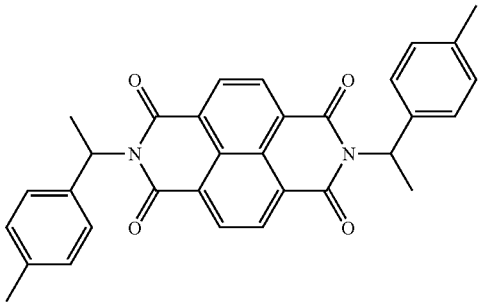

Formula 53

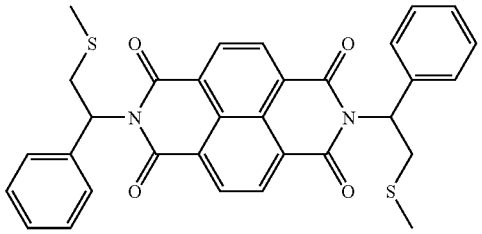

Formula 54

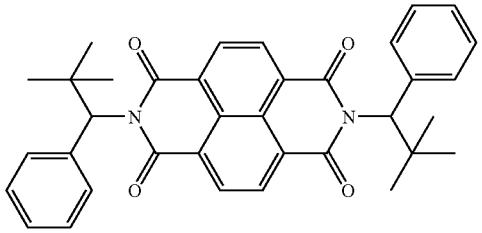

The electrophotographic photoreceptor according to an embodiment of the present invention may contain a hole transferring material additionally.

The hole transferring material includes, for example, poly-N-vinylcarbazole, phenanthrene, N-ethylcarbazole, 2,5-diphenyl-1,3,4-oxadiazole, 2,5-bis-(4-diethylaminophenyl)-1,3,4-oxadiazole, bis-diethylaminophenyl-1,3,6-oxadiazole, 4,4'-bis(diethylamino)-2,2'-dimethyltriphenylmethane, 2,4,5-triaminophenylimidazole, 2,5-bis(4-diethylaminophenyl)-1,3,4-triazole, 1-phenyl-3-(4-diethylaminostyryl)-5-(4-diethylaminophenyl)-2-pyrazoline, tetra(m-methylphenyl)methaphenylenediamine, N,N,N',N'-tetraphenylbenzidine derivative, N,N'-diphenyl-N,N'-disilylbenzidine, or the like, but is not limited thereto.

The above-mentioned hole transferring material may be used individually or in combination with each other.

The specific examples of the hole transferring material which may be used in the present invention are as follows.

Formula 55

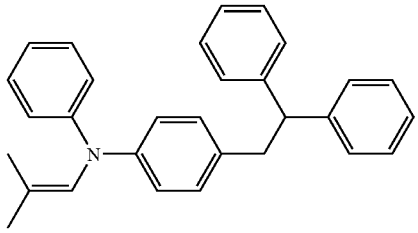

Formula 56

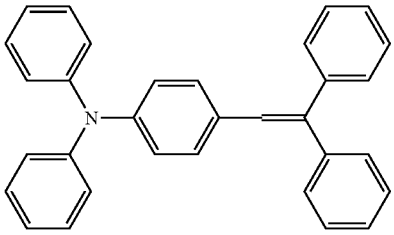

Formula 57

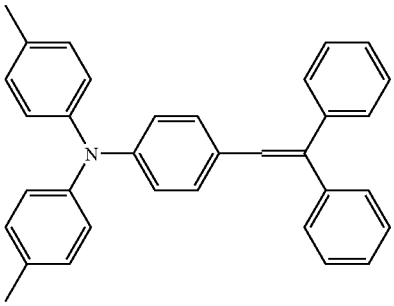

Formula 58

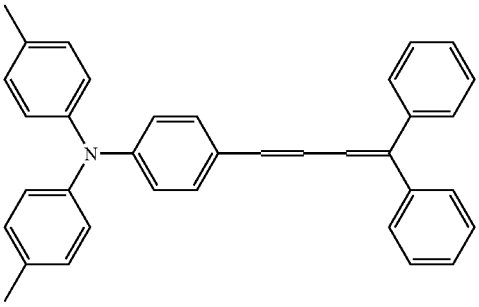

Formula 59

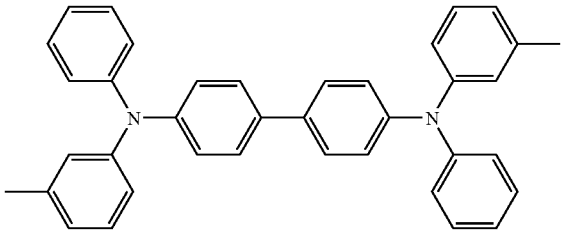

The above-mentioned charge generating material and charge transferring material are dispersed in a binder resin. The binder resin includes, for example, styrene-butadiene copolymer; polyvinyl toluene-styrene copolymer; silicone resin, styrene-alkyd resin, silicone-alkyd resin; soya-alkyd resin; poly(vinyl chloride); poly(vinylidene chloride); vinylidene chloride-acrylonitrile copolymer; poly(vinyl acetate); vinyl acetate-vinyl chloride copolymer; poly(vinyl acetal) such as poly(vinyl butyral), and the like; poly(acrylic and methacrylic ester) such as poly(methyl methacrylate), poly(n-butyl methacrylate), poly(isobutyl methacryalte), and the like; polystyrene, nitrated polystyrene; polymethylstyrene; isobutylene polymer; polyester such as poly, poly, and the like; phenolformaldehyde resin; ketone resin; polyamide; polycarbonate; polythiocarbonate; poly; chlorinated polyolefin such as chlorinated polyethylene; and compounds equivalent to the above-mentioned compounds, but is not limited thereto.

Examples of the solvent used in the photoconductive layer of the electrophotographic photoreceptor include organic solvents such as ketone type solvents, amide type solvents, ether type solvents, ester type solvents, sulfone type solvents, aromatic type solvents, aliphatic halogenated hydrocarbon type solvents and the like, but are not limited thereto.

Generally, the electrophotographic photoreceptor according to an embodiment of the present invention additionally contains an undercoating layer between the conductive substrate and the photoconductive layer to improve the adhesive property between the conductive substrate and the photoconductive layer and prevent the hole injection from the conductive substrate to the photoconductive layer.

In addition, typically the electrophotographic photoreceptor according to an embodiment of the present invention contains a protective layer additionally on the photoconductive layer to protect the photoconductive layer from scratching or abrasion during the cleaning process, and the like.

For the purpose of preventing the hole migration from the substrate to the photoconductive layer by the undercoating layer of the electrophotographic photoreceptor, it is advantageous that the undercoating layer be as thick as possible. However, as the undercoating layer becomes thicker, the electron migration from the photoconductive layer is also prevented, so that the exposure potential is raised. Thus, generally an undercoating layer that includes an electron transferring material is provided to the electrophotographic photoreceptor.

The electrophotographic photoreceptor according to an embodiment of the present invention comprises a conductive substrate, a photoconductive layer formed on the conductive layer, and an undercoating layer formed between the conductive substrate and the photoconductive layer, wherein the undercoating layer includes the above-described phenylazomethylene-cyclohexadienone derivative of Formula 5.

In the electrophotographic photoreceptor comprising the undercoating layer that includes the phenylazomethylene-cyclohexadienone derivative of Formula 5, the conductive substrate and the photoconductive layer are as described above.

Figure 2:
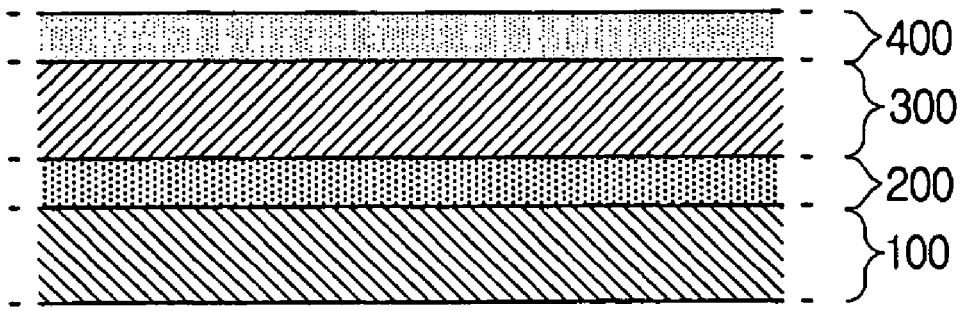
FIG. 2 is a schematic cross-sectional view of a single layer type electrophotographic photoreceptor according to an embodiment of the present invention.
Figure 3:
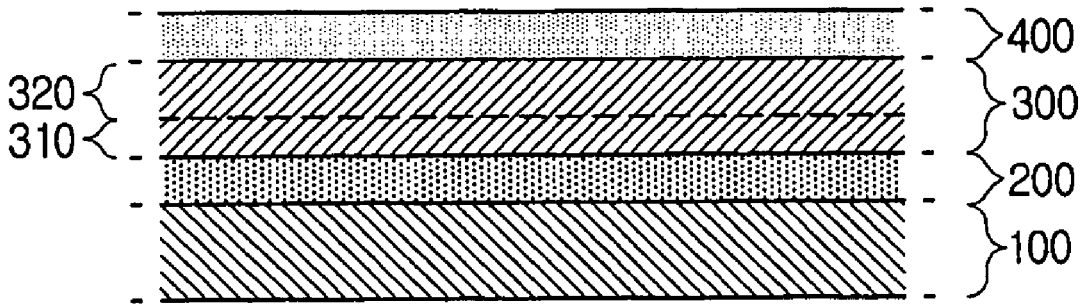
FIG. 3 is a schematic cross-sectional view of a laminate type electrophotographic photoreceptor according to another embodiment of the present invention.

FIGS. 2 and 3 schematically show examples of the above-described electrophotographic photoreceptors according to embodiments of the present invention. In the drawings, the same drawing reference numerals are used for the same elements, even in different drawings.

Referring to FIGS. 2 and 3, a conductive layer (100), an undercoating layer (200) formed on the conductive layer (100), a photoconductive layer (300) formed on the undercoating layer (200), and a protective layer (400) formed on the photoconductive layer (300) are laminated in order.

The example shown in FIG. 2 represents a single layer type electrophotographic photoreceptor having a photoconductive layer (300) with a single layer structure, wherein the charge generating material and the charge transferring material are dispersed together in a single layer.

The example shown in FIG. 3 represents a laminate type electrophotographic photoreceptor having a photoconductive layer (300) with a laminate structure, wherein the charge generating layer (310) in which the charge generating material is dispersed and the charge transferring layer (320) in which the charge transferring material is dispersed are laminated.

Next, the present invention will be explained more specifically with reference to Examples, but the present invention is not restricted by these Examples described below.

EXAMPLES

Synthesis of Electron Transferring Material

Example 1

See the above schemes 1 and 2. Among the above-exemplified electron transferring materials, the phenylazomethylene-cyclohexadienone derivative of Formula 18 was synthesized.

23.4 g (0.1 mol) of 3,5-di-tert-butyl-4-hydroxy-benzaldehyde represented by the following Formula 60:

Formula 60

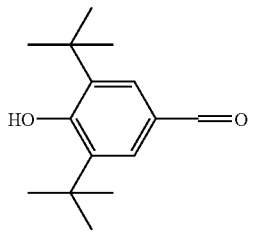

and 16 g (0.105 mol) of (4-nitrophenyl)-hydrazine represented by the following Formula 61:

Formula 61

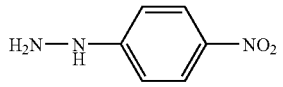

were added dropwise to 300 ml of ethanol, and temperature was increased to dissolve them to prepare a solution.

Then, one drop of aqueous solution of high concentration hydrochloric acid was added to the solution, and it was refluxed for 2 hours. The refluxed solution was cooled to room temperature, and the precipitated solid was filtered. The filtered solid was recrystallized from acetone/ethanol cosolvent. In this way, 30 g of orange solid was obtained, which was the compound represented by the following Formula 62:

Formula 62

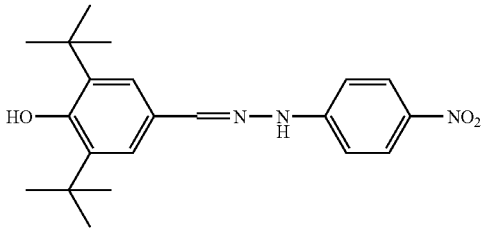

The yield of the compound was 81%.

14.76 g of the orange solid was dissolved in 150 ml of chloroform to prepare a solution, and 20 g of manganese oxide ($MnO_2$) was added slowly thereto. Then, the resulting solution was stirred for 2 hours at room temperature. After the oxidation reaction ended, the solution was filtered to remove the manganese oxide, and the solvent was volatilized. The resulting solid was recrystallized with ethanol to obtain 12.04 g of a brown solid. The brown solid was the phenylazomethylene-cyclohexadienone derivative of Formula 18. The yield of the brown solid was 83%.

The NMR spectrum of the phenylazomethylene-cyclohexadienone derivative synthesized as described above was measured. The results are shown FIG. 1.

Preparation of Electrophotographic Photoreceptor

Example 2

| | |
|---|---|
| Compound of the above Formula 18 (electron transferring material) | 6.6 part by weight |
| Compound of the following Formula 63 (charge generating material) | 0.9 part by weight |
| Compound of the above Formula 55 (hole transferring material) | 6.6 parts by weight |
| Compound of the following formula 64 (binder) | 15.9 part by weight |
| Methylene chloride | 80.5 part by weight |
| 1,1,2-trichloroethane | 34.5 part by weight |

The components were mixed, ground by sand milling for 2 hours and dispersed by ultrasonic wave to prepare a coating liquid for forming a photoconductive layer. Then, the coating liquid was applied by a ring coating process on an aluminum drum, and dried for 1 hour at 110° C., to prepare a single layer type electrophotographic photoreceptor.

The thickness of the prepared electrophotographic photoreceptor was about 13 μm.

Formula 63

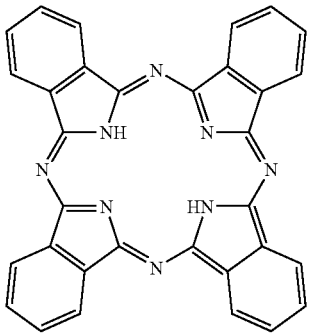

Formula 64

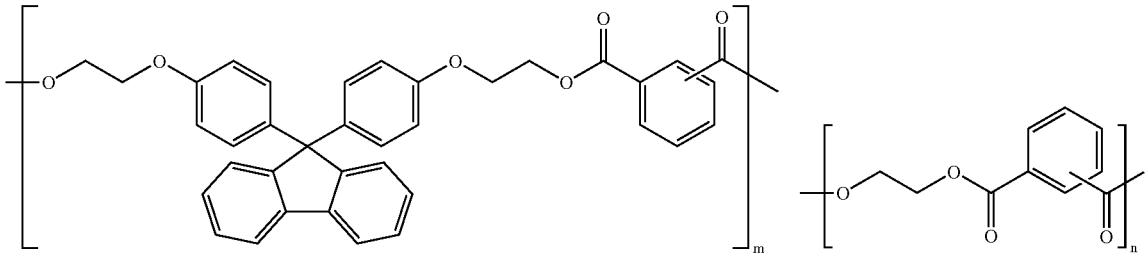

Example 3

| | |
|---|---|
| Compound of the above Formula 18 (electron accepting material) | 0.3 part by weight |
| Compound of the above Formula 36 (electron transferring material) | 6.3 part by weight |
| Compound of the above Formula 63 (charge generating material) | 0.9 part by weight |
| Compound of the above Formula 55 (hole transferring material) | 6.6 parts by weight |
| Compound of the above Formula 64 (binder) | 15.9 part by weight |
| Methylene chloride | 80.5 part by weight |
| 1,1,2-trichloroethane | 34.5 part by weight |

The components were mixed, ground by sand milling for 2 hours and dispersed by ultrasonic wave to prepare a coating liquid for forming a photoconductive layer. Then, the coating liquid was applied by a ring coating process on an aluminum drum, and dried for 1 hour at 110° C., to prepare a single layer type electrophotographic photoreceptor.

The thickness of the prepared electrophotographic photoreceptor was about 14 μm.

Example 4

| | |
|---|---|
| Compound of the above Formula 18 (electron accepting material) | 0.3 part by weight |
| Compound of the above Formula 37 (electron transferring material) | 6.3 part by weight |
| Compound of the above Formula 63 (charge generating material) | 0.9 part by weight |
| Compound of the above Formula 55 (hole transferring material) | 6.6 parts by weight |
| Compound of the above Formula 64 (binder) | 15.9 part by weight |
| Methylene chloride | 80.5 part by weight |
| 1,1,2-trichloroethane | 34.5 part by weight |

The components were mixed, ground by sand milling for 2 hours and dispersed by ultrasonic wave to prepare a coating liquid for forming a photoconductive layer. Then, the coating liquid was applied by a ring coating process on an aluminum drum, and dried for 1 hour at 110° C., to prepare a single layer type electrophotographic photoreceptor.

The thickness of the prepared electrophotographic photoreceptor was about 14 μm.

Comparative Example 1

| | |
|---|---|
| Compound of the above Formula 36 (electron transferring material) | 6.6 part by weight |
| Compound of the above Formula 63 (charge generating material) | 0.9 part by weight |
| Compound of the above Formula 55 (hole transferring material) | 6.6 parts by weight |
| Compound of the above Formula 64 (binder) | 15.9 part by weight |
| Methylene chloride | 80.5 part by weight |
| 1,1,2-trichloroethane | 34.5 part by weight |

The components were mixed, ground by sand milling for 2 hours and dispersed by ultrasonic wave to prepare a coating liquid for forming a photoconductive layer. Then, the coating liquid was applied by a ring coating process on an aluminum drum, and dried for 1 hour at 110° C., to prepare a single layer type electrophotographic photoreceptor.

The thickness of the prepared electrophotographic photoreceptor was about 13 μm.

Comparative Example 2

| | |
|---|---|
| Compound of the above Formula 37 (electron transferring material) | 6.6 part by weight |
| Compound of the above Formula 63 (charge generating material) | 0.9 part by weight |
| Compound of the above Formula 55 (hole transferring material) | 6.6 parts by weight |
| Compound of the above Formula 64 (binder) | 15.9 part by weight |
| Methylene chloride | 80.5 part by weight |
| 1,1,2-trichloroethane | 34.5 part by weight |

The components were mixed, ground by sand milling for 2 hours and dispersed by ultrasonic wave to prepare a coating liquid for forming a photoconductive layer. Then, the coating liquid was applied by a ring coating process on an aluminum drum, and dried for 1 hour at 110° C., to prepare a single layer type electrophotographic photoreceptor.

The thickness of the prepared electrophotographic photoreceptor was about 13 μm.

Test

The initial charging potential and exposure potential and the charging potential and exposure potential after 6000 cycles of the electrophotographic photoreceptors prepared according to Example 2, Example 3, Example 4, Comparative Example 1 and Comparative Example 2 were measured and compared. The results are shown in Table 1.

The electrophotographic photoreceptors prepared in Examples and Comparative Examples were (+) type single-layered electrophotographic photoreceptors.

TABLE 1

| | $V_0$ | $V_d$ | $V_0$ 6000 | $V_d$ 6000 |
|---|---|---|---|---|
| Example 2 | 980 | 100 | 950 | 110 |
| Example 3 | 990 | 95 | 975 | 100 |
| Example 4 | 980 | 105 | 965 | 110 |
| Comparative Example 1 | 980 | 78 | 895 | 82 |
| Comparative Example 2 | 990 | 70 | 870 | 80 |

In Table 1, $V_0$ is an initial charging potential, $V_d$ is an initial exposure potential, $V_0$ 6000 is a charging potential after 6000 cycles, and $V_d$ 6000 is an exposure potential after 6000 cycles.

In Example 2, the compound of Formula 18, according to an embodiment of the present invention, was used as an electron transferring material without another electron transferring material to form a photoconductive layer, and in Example 3 and Example 4, the compound of Formula 18 was used as an electron accepting material and the compound having naphthalenetetracarboxylic diimide structure was used as an electron transferring material to form the photoconductive layer. The charging potential was changed by −30 after 6000 cycles in Example 2, and thus, the charging potential was maintained stably; both charging potentials were changed by −15 in Example 3 and Example 4, and thus, they were maintained more stably. Therefore, although an electrophotographic photoreceptor having an improved electrostatic characteristic may be obtained when the electron transferring material according to an embodiment of the present invention is used singly, an electrophotographic photoreceptor having an even more improved electrostatic characteristic may be obtained when the electron transferring material according to an embodiment of the present invention is used in combination with other electron transferring materials.

On the other hand, in Comparative Example 1 and Comparative Example 2, the phenylazomethylene-cyclohexadienone derivative according to embodiments of the invention was not used, and only the naphthalenetetracarboxylic diimide derivatives used in Example 3 and Example 4 were included in the electrophotographic photoreceptors. The charging potentials were changed largely by −95 and −120 respectively after 6000 cycles in Comparative Example 1 and Comparative Example 2, and thus, the charging potential became unstable after several uses. Hence, the quality of the printed image decreases after several uses, shortening the lifespan of the electrophotographic photoreceptor.

Thus, the electrophotographic photoreceptor comprising the electron transferring material according to embodiments of the present invention shows an excellent charging potential stability.

According to embodiments of the present invention, as described above, by synthesizing a new phenylazomethylene-cyclohexadienone derivative which has an excellent electron accepting capacity and electron transferring capability by comprising an electron withdrawing group, and using it as an electron transferring material, an electrophotographic photoreceptor having an effective electrical property and wherein the image quality is desirable even after being used for a prolonged period may be provided.

Figure 4:
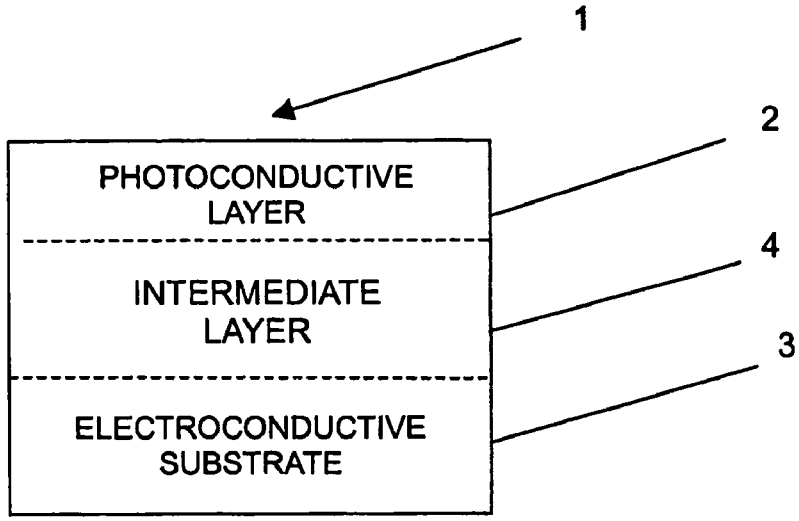
FIG. 4 is a block diagram illustrating (not to scale) an electrophotographic photoreceptor comprising an electroconductive substrate, a photoconductive layer and, where desired, an undercoat interposed between the electroconductive substrate and the photoconductive layer in accordance with an embodiment of the present invention.

FIG. 4 is a block diagram illustrating (not to scale) an electrophotographic photoreceptor 1 comprising an electroconductive substrate 3 and a photoconductive layer 2, and where desired, an intermediate/undercoat layer 4, in accordance with an embodiment of the present invention.

Figure 5:
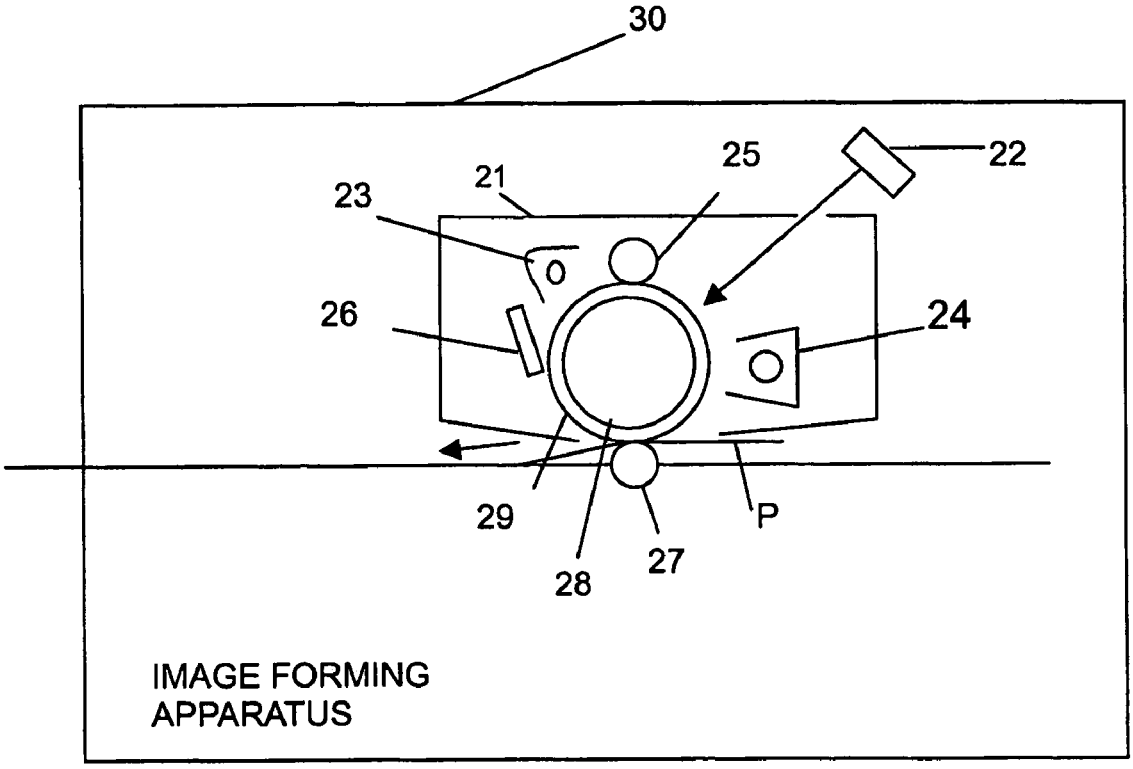
FIG. 5 is a schematic representation of an image forming apparatus, an electrophotographic drum, and an electrophotographic cartridge in accordance with selected embodiments of the present invention.

FIG. 5 is a schematic representation of an image forming apparatus 30, an electrophotgraphic drum 28, and an electrophographic cartridge 21 in accordance with selected embodiments of the present invention. The electrophotographic cartridge 21 typically comprises an electrophotographic photoreceptor 29 and at least one of a charging device 25 that charges the electrophotographic photoreceptor 29, a developing device 24 which develops an electrostatic latent image formed on the electrophotographic photoreceptor 29, and a cleaning device 26 which cleans a surface of the electrophotographic photoreceptor 29. The electrophotographic cartridge 21 may be attached to or detached from the image forming apparatus 30, and the electrophotographic photoreceptor 29 is described more fully above.

The electrophotographic photoreceptor drum 28, 29 for an image forming apparatus 30, generally includes a drum 28 that is attachable to and detachable from the electrophotographic apparatus 30 and that includes an electrophotographic photoreceptor 29 disposed on the drum 28, wherein the electrophotographic photoreceptor 29 is described more fully above.

Generally, the image forming apparatus 30 includes a photoreceptor unit (e.g., an electrophotographic photoreceptor drum 28, 29), a charging device 25 which charges the photoreceptor unit, an imagewise light irradiating device 22 which irradiates the charged photoreceptor unit with imagewise light to form an electrostatic latent image on the photoreceptor unit, a developing unit 24 that develops the electrostatic latent image with a toner to form a toner image on the photoreceptor unit, and a transfer device 27 which transfers the toner image onto a receiving material, such as paper P, wherein the photoreceptor unit comprises an electrophotographic photoreceptor 29 as described in greater detail above. The charging device 25 may be supplied with a voltage as a charging unit and may contact and charge the electrophotographic receptor. Where desired, the apparatus may include a pre-exposure unit 23 to erase residual charge on the surface of the electrophotographic photoreceptor to prepare for a next cycle.

The electrophotographic image forming apparatus 30 includes a plurality of support rollers 25, 27 (in the embodiment shown, the support rollers are the charging drive 25 and the transfer device 27). The electrophotographic photoreceptor 29 is operably coupled to the support rollers 25, 27 such that motion of the support rollers 25, 27 results in motion of the electrophotographic photoreceptor 29.

Where desired, the photoreceptor may have a protective layer disposed thereon (not shown in FIG. 4).

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electrophotographic photoreceptor comprising:

a conductive substrate; and a photoconductive layer formed on the conductive substrate, wherein the photoconductive layer comprises:

a charge generating material; and a charge transferring material, wherein the charge transferring material comprises:

a phenylazomethylene-cyclohexadienone derivative represented by the following Formula 5:

Formula 5

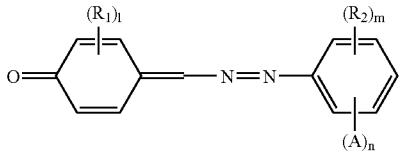

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen;

A is selected from the group consisting of a nitro group, a cyano group and a sulfone group;

l is a natural number of 0 to 4;

m is a natural number of 0 to 4; and n is a natural number of 1 to 5.

2. The electrophotographic photoreceptor according to claim 1, wherein a content of the charge transferring material is in a range of 0.1 to 4% by weight with respect to a weight of total solid.

3. The electrophotographic photoreceptor according to claim 1, wherein the charge transferring material is a mixture of the phenylazomethylene-cyclohexadienone derivative of Formula 5 and a compound of the following Formula 11:

Formula 11

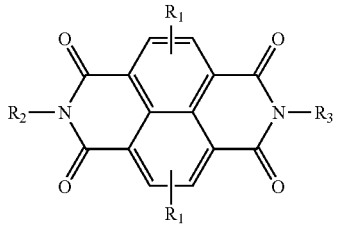

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

4. The electrophotographic photoreceptor according to claim 3, wherein a mixing ratio of {the phenylazomethylene-cyclohexadienone derivative of Formula 5}/{the phenylazomethylene-cyclohexadienone derivative of Formula 5+the compound of Formula 11} is in a range of 0.01 to 1.

5. The electrophotographic photoreceptor according to claim 1, wherein the charge transferring material is a mixture of the phenylazomethylene-cyclohexadienone derivative of Formula 5 and a compound of the following Formula 12:

Formula 12

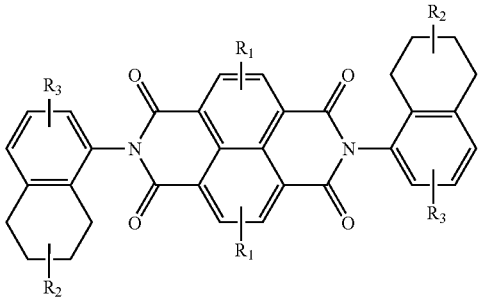

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

6. The electrophotographic photoreceptor according to claim 5, wherein a mixing ratio of {the phenylazomethylene-cyclohexadienone derivative of Formula 5}/{the phenylazomethylene-cyclohexadienone derivative of Formula 5+the compound of Formula 12} is in a range of 0.01 to 1.

7. The electrophotographic photoreceptor according to claim 1, wherein the charge transferring material is a mixture of the phenylazomethylene-cyclohexadienone derivative of the above Formula 5 and compound of the following Formula 13:

Formula 13

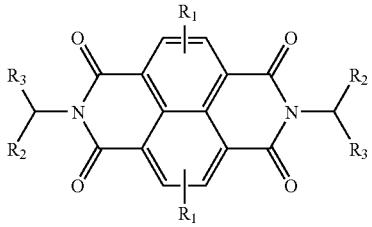

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; and $R_3$ is a substituted or unsubstituted aryl group having 6 to 30 carbon atoms.

8. The electrophotographic photoreceptor according to claim 7, wherein a mixing ratio of {the phenylazomethylene-cyclohexadienone derivative of Formula 5}/{the phenylazomethylene-cyclohexadienone derivative of Formula 5+the compound of Formula 13} is in a range of 0.01 to 1.

9. The electrophotographic photoreceptor according to claim 1, wherein the photoconductive layer has a single layer structure wherein the charge transferring material and the charge generating material are dispersed together in a single layer.

10. The electrophotographic photoreceptor according to claim 9, wherein the electrophotographic photoreceptor further includes a hole transferring material.

11. The electrophotographic photoreceptor according to claim 1, wherein the photoconductive layer has a laminate structure wherein the charge transferring material and the charge generating material are dispersed in separate layers respectively.

12. The electrophotographic photoreceptor according to claim 1, wherein the electrophotographic photoreceptor further includes an undercoating layer between the conductive substrate and the photoconductive layer in order to improve an adhesive property between the conductive substrate and the photoconductive layer.

13. The electrophotographic photoreceptor according to claim 1, wherein the electrophotographic photoreceptor further includes a protective layer on the photoconductive layer.

14. An electrophotographic photoreceptor comprising:

a conductive substrate;

a photoconductive layer formed on the conductive substrate; and an undercoating layer formed between the conductive substrate and the photoconductive layer to improve an adhesive property between the conductive substrate and the photoconductive layer, wherein the undercoating layer includes an electron transferring material, and the electron transferring material comprises:

a phenylazomethylene-cyclohexadienone derivative represented by the following Formula 5:

Formula 5

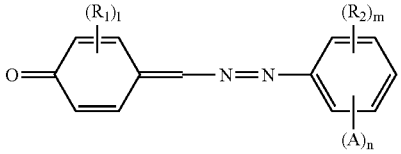

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen;

A is selected from the group consisting of a nitro group, a cyano group and a sulfone group;

l is a natural number of 0 to 4;

m is a natural number of 0 to 4; and n is a natural number of 1 to 5.

15. The electrophotographic photoreceptor according to claim 14, wherein a content of the electron transferring material is in a range of 0.1 to 4% by weight with respect to a weight of total solid.

16. The electrophotographic photoreceptor according to claim 14, wherein the electron transferring material is a mixture of the phenylazomethylene-cyclohexadienone derivative of Formula 5 and a compound of the following Formula 11:

Formula 11

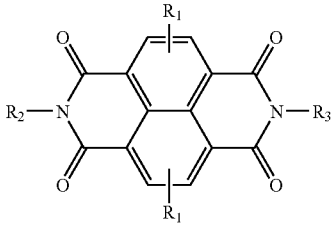

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

17. The electrophotographic photoreceptor according to claim 16, wherein a mixing ratio of {the phenylazomethylene-cyclohexadienone derivative of Formula 5}/{the phenylazomethylene-cyclohexadienone derivative of Formula 5+the compound of Formula 11} is in a range of 0.01 to 1.

18. The electrophotographic photoreceptor according to claim 14, wherein the electron transferring material is a mixture of the phenylazomethylene-cyclohexadienone derivative of Formula 5 and the compound of the following Formula 12:

Formula 12

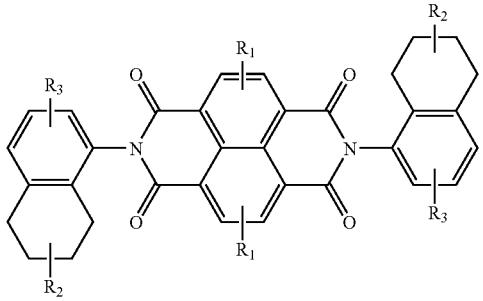

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

19. The electrophotographic photoreceptor according to claim 18, wherein a mixing ratio of {the phenylazomethylene-cyclohexadienone derivative of Formula 5}/{the phenylazomethylene-cyclohexadienone derivative of Formula 5+the compound of Formula 12} is in a range of 0.01 to 1.

20. The electrophotographic photoreceptor according to claim 14, wherein the electron transferring material is a mixture of the phenylazomethylene-cyclohexadienone derivative of Formula 5 and compound of the following Formula 13:

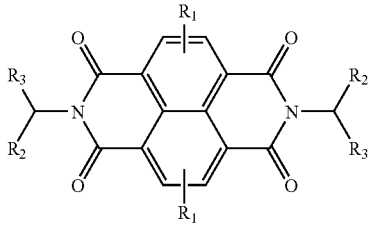

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; and $R_3$ is a substituted or unsubstituted aryl group having 6 to 30 carbon atoms.

21. The electrophotographic photoreceptor according to claim 20, wherein a mixing ratio of {the phenylazomethylene-cyclohexadienone derivative of formula (I)}/{the phenylazomethylene-cyclohexadienone derivative of Formula 5+the compound of Formula 13} is in a range of 0.01 to 1.

22. The electrophotographic photoreceptor of claim 1, wherein the charge transferring material comprises a phenylazomethylene-cyclohexadienone derivative represented by the following Formula 14:

Formula 14

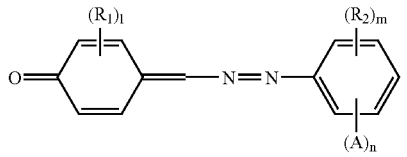

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; A is selected from the group consisting of a nitro group, a cyano group and a sulfone group; l is a natural number of 0 to 4; m is a natural number of 0 to 4; and n is a natural number of 1 to 5.

23. The electrophotographic photoreceptor of claim 22, wherein the charge transferring material is a mixture of the phenylazomethylene-cyclohexadienone derivative of Formula 14 and the compound of the following Formula 15:

Formula 15

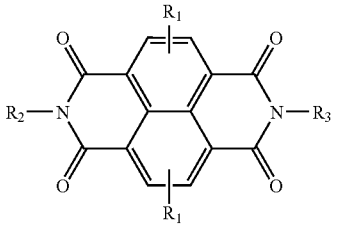

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

24. The electrophotographic photoreceptor of claim 22, wherein the charge transferring material is a mixture a mixture of the phenylazomethylene-cyclohexadienone derivative of Formula 14 and the compound of the following Formula 16:

Formula 16

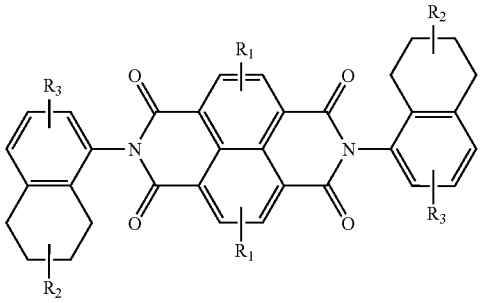

wherein $R_1$, $R_2$ and $R_3$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen.

25. The electrophotographic photoreceptor of claim 22, wherein the charge transferring material is a mixture a mixture of the phenylazomethylene-cyclohexadienone derivative of Formula 14 and the compound of the following Formula 17:

Formula 17

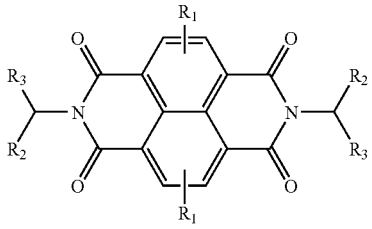

wherein $R_1$ and $R_2$ are independently selected from the group consisting of a substituted or unsubstituted alkyl group having 1 to 20 carbon atom(s), a substituted or unsubstituted alkoxy group having 1 to 20 carbon atom(s), a substituted or unsubstituted aryl group having 6 to 30 carbon atoms, a substituted or unsubstituted aralkyl group having 7 to 30 carbon atoms, and a halogen; and $R_3$ is a substituted or unsubstituted aryl group having 6 to 30 carbon atoms.

26. The electrophotographic photoreceptor of claim 1, wherein the phenylazomethylene-cyclohexadienone derivative of Formula 5 is at least one of the following Formulas 18-35:

Formula 18

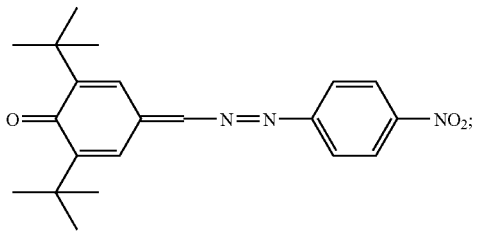

Formula 19

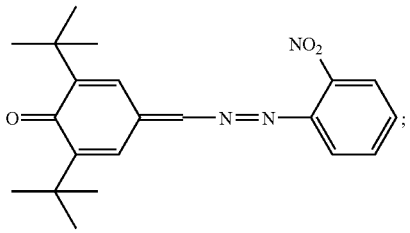

-continued
Formula 20
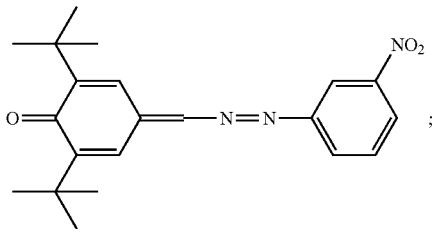
Formula 21
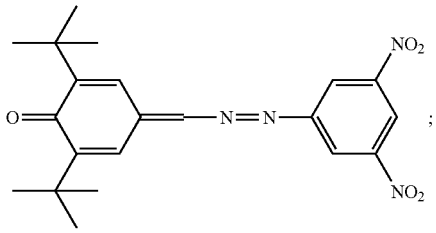
Formula 22
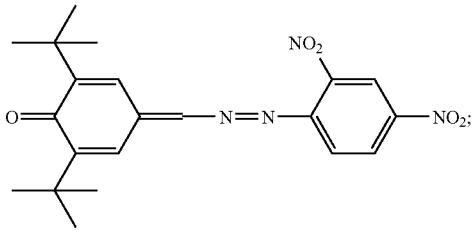
Formula 23
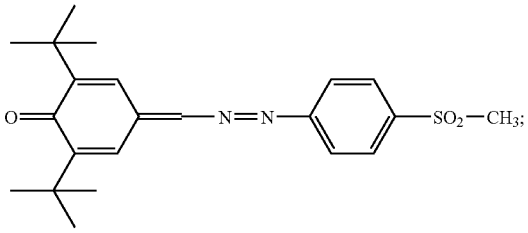
Formula 24
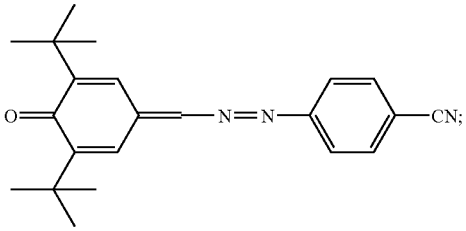
Formula 25
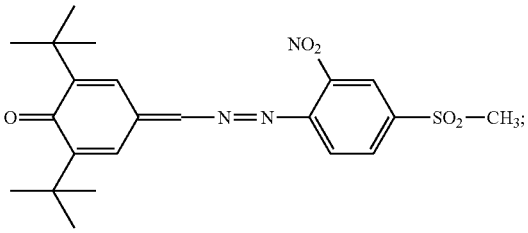
-continued
Formula 26
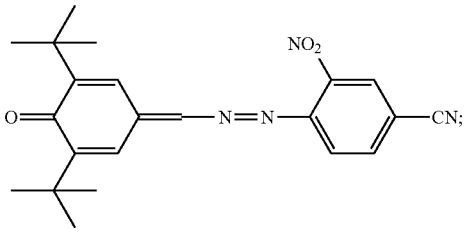
Formula 27
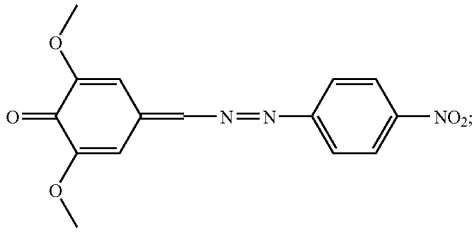
Formula 28
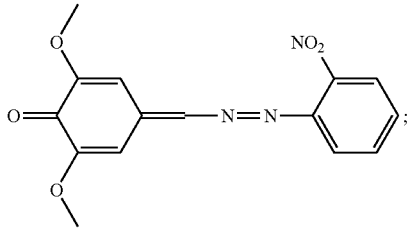
Formula 29
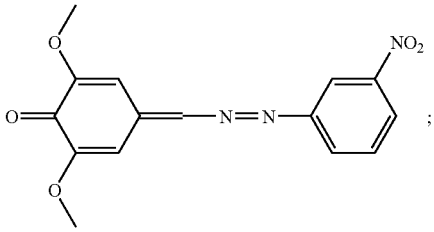
Formula 30
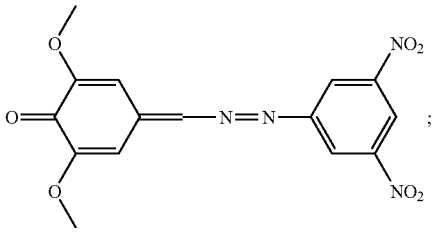
Formula 31
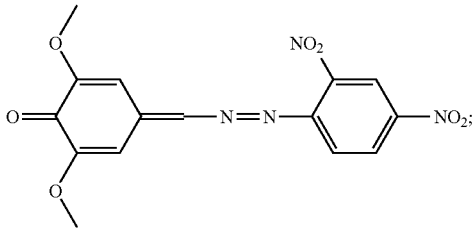

-continued
Formula 32
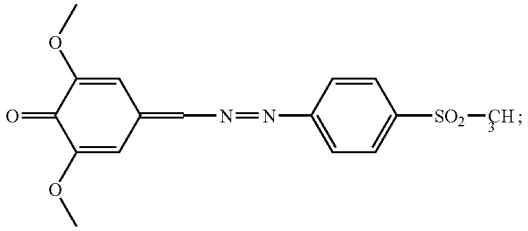
Formula 33
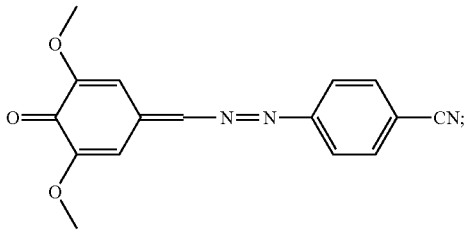
Formula 34
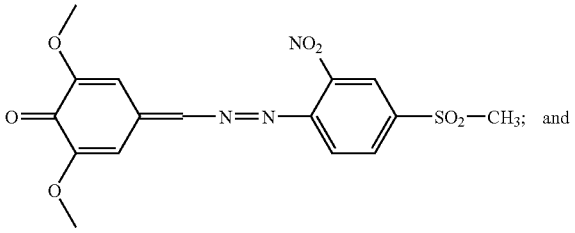
Formula 35
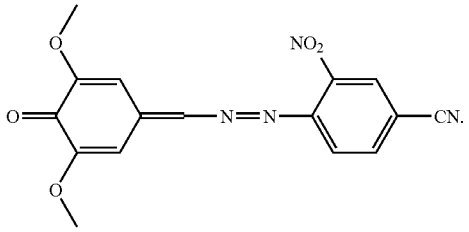
27. The electrophotographic photoreceptor according to claim 1, wherein the charge transferring material is a mixture of the phenylazomethylene-cyclohexadienone derivative of Formula 5 and a compound of one of the following Formulas 36-54:
Formula 36
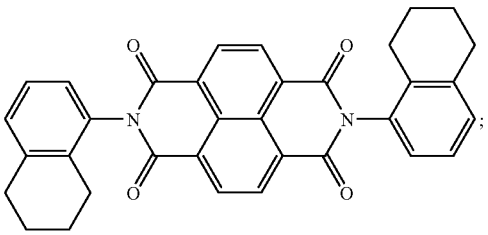
-continued
Formula 37
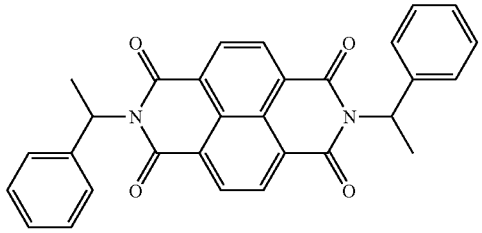
Formula 38
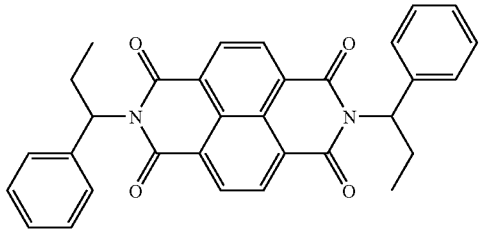
Formula 39
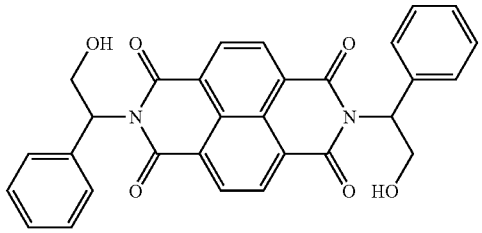
Formula 40
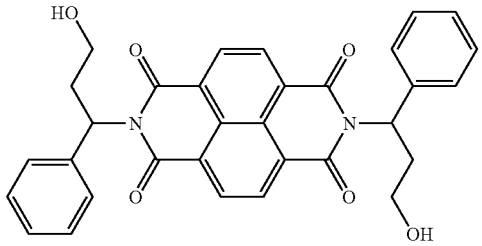
Formula 41
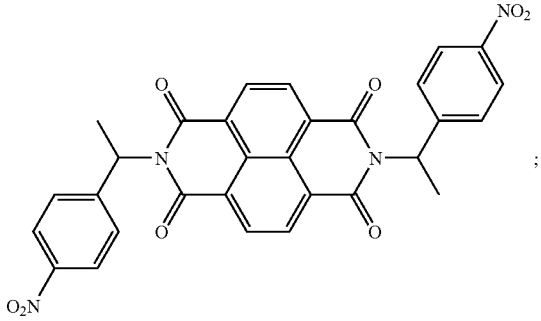

-continued
Formula 42
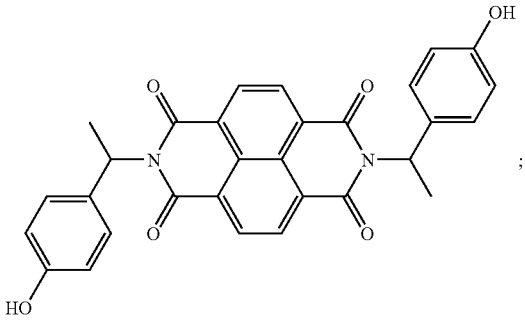
;
Formula 43
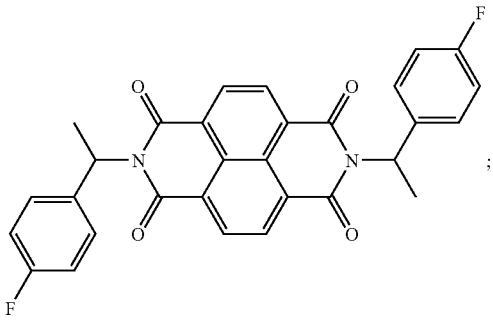
;
Formula 44
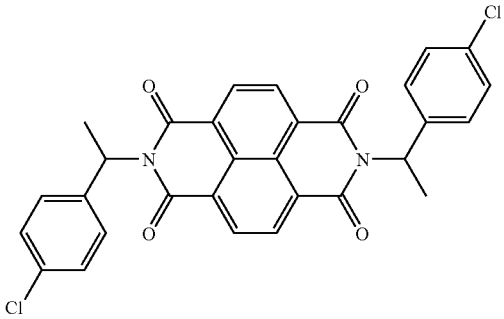
;
Formula 45
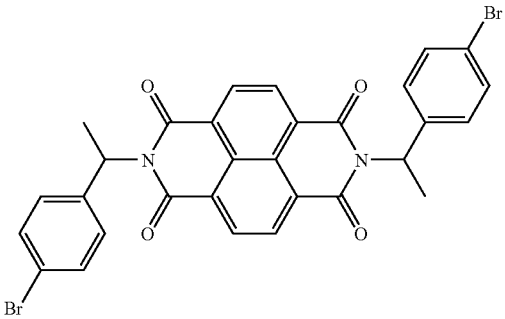
;
Formula 46
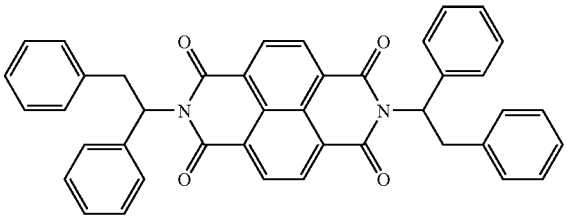
;
-continued
Formula 47
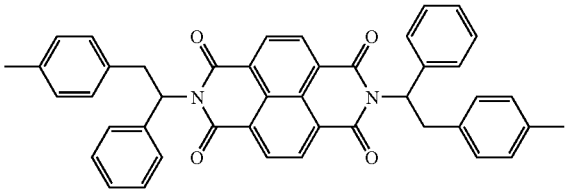
;
Formula 48
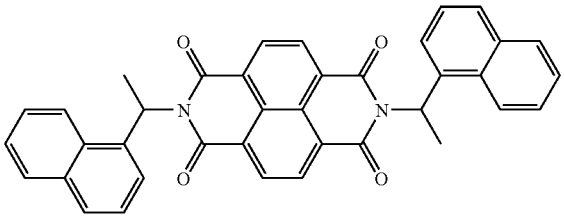
;
Formula 49
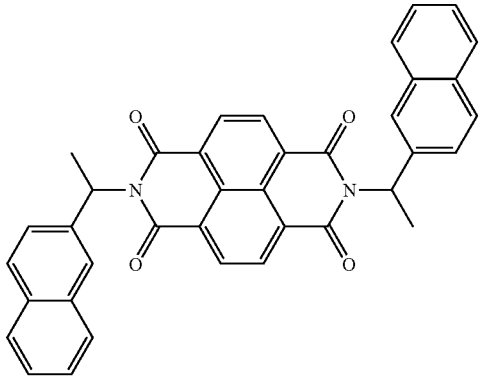
;
Formula 50
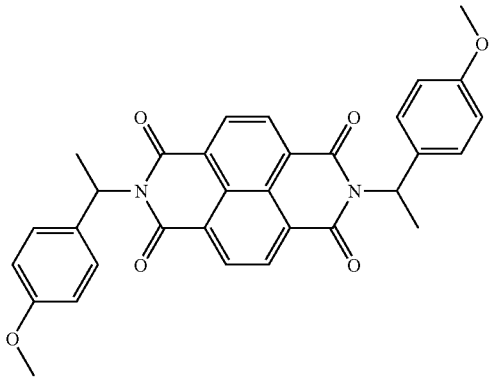
;
Formula 51
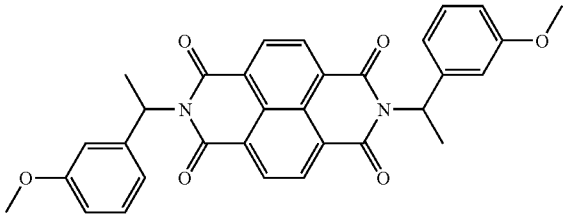
;

-continued
Formula 52
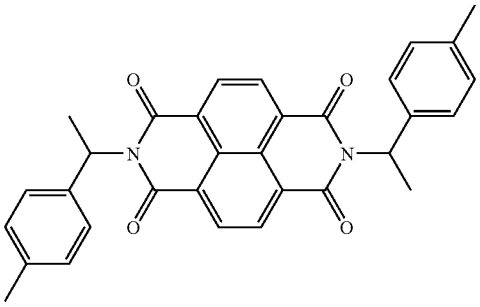
;
Formula 53
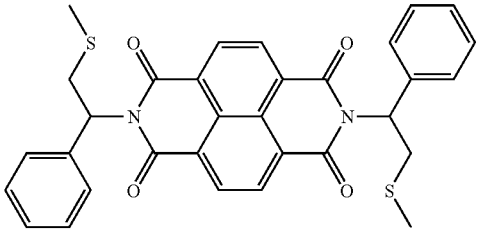
; and
Formula 54
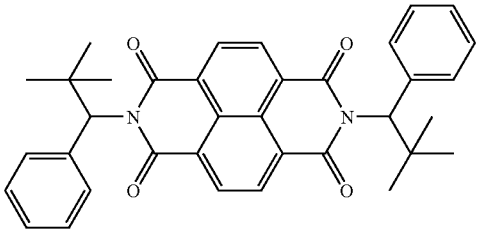
.
28. The electrophotographic photoreceptor according to claim 10, wherein the hole transferring material is at least one of:
Formula 55
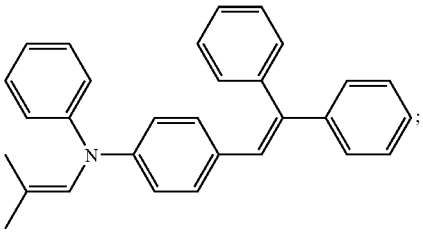
;
-continued
Formula 56
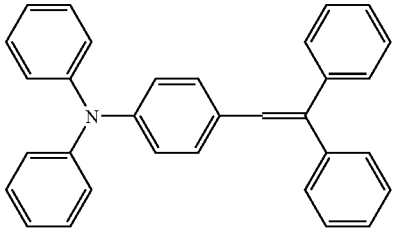
;
Formula 57
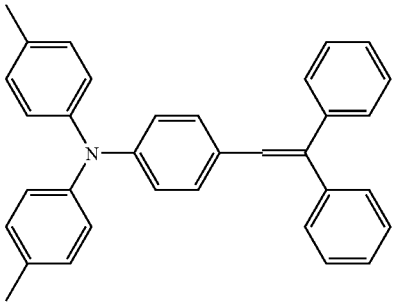
;
Formula 58
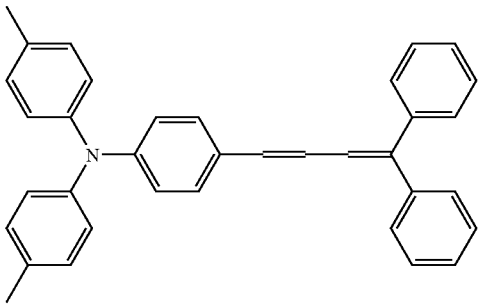
; and
Formula 59
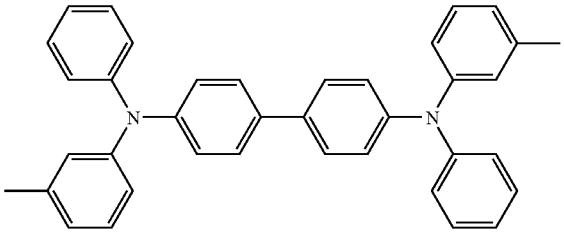
.
* * * * *

UNITED STATES PATENT AND TRADEMARK OFFICE

CERTIFICATE OF CORRECTION

PATENT NO. : 7,314,692 B2
APPLICATION NO. : 10/964740
DATED : January 1, 2008
INVENTOR(S) : Beom-jun Kim et al.

It is certified that error appears in the above-identified patent and that said Letters Patent is hereby corrected as shown below:

Column 39 (Formula 32) (Structure) Line 8 Claim 28, change "$_3$CH" to --$CH_3$--.

Signed and Sealed this

Fifteenth Day of July, 2008

JON W. DUDAS
*Director of the United States Patent and Trademark Office*